US005735390A

United States Patent [19]

Takagi et al.

[11] Patent Number: 5,735,390

[45] Date of Patent: Apr. 7, 1998

[54] KEYSWITCH DEVICE

[75] Inventors: Takeyuki Takagi, Nagoya; Isao Mochizuki, Gifu-ken, both of Japan

[73] Assignee: Brother Kogyo Kabushiki Kaisha, Nagoya, Japan

[21] Appl. No.: 666,072

[22] Filed: Jun. 19, 1996

Related U.S. Application Data

[63] Continuation-in-part of Ser. No. 495,076, Jun. 27, 1995, abandoned.

[30] Foreign Application Priority Data

| | | | |
|---|---|---|---|
| Jul. 20, 1994 | [JP] | Japan | 6-190991 |
| Jul. 20, 1994 | [JP] | Japan | 6-190992 |
| Jun. 29, 1995 | [JP] | Japan | 7-163606 |
| Aug. 28, 1995 | [JP] | Japan | 7-218455 |

[51] Int. Cl.[6] ..... H01H 13/70

[52] U.S. Cl. ..... 200/344; 200/341

[58] Field of Search ..... 200/344, 341, 200/345, 520, 512, 517

[56] References Cited

U.S. PATENT DOCUMENTS 5,268,545 12/1993 Druner ..... 200/244

*Primary Examiner*—David J. Walczak
*Attorney, Agent, or Firm*—Oliff & Berridge

[57] ABSTRACT

A key switch device includes a key top whose position can be selectively changed to operative position or non operating position. In the operative position, the key top can be moved downwardly and upwardly by biasing force of a rubber spring. The key top is supported on a support plate by first and second link members pivotally connected to each other. A pivot connecting portion of the first and second link members is seated on the rubber spring when the key top is in its operative position. The rubber spring is fixed to a circuit board which is slidable with respect to the support plate. By sliding the circuit board, the position of the rubber spring is offset from the pivot connecting portion, so that the first and second link members can be folded up. The first and second link members are directly supported by the support plate.

37 Claims, 16 Drawing Sheets

KEYSWITCH DEVICE

CROSS-REFERENCE TO RELATED APPLICATIONS

This application is a continuation-in-part of application Ser. No. 08/495,076, filed on Jun. 27, 1995, now abandoned.

BACKGROUND OF THE INVENTION

The present invention relates to a keyswitch device used for a keyboard provided on a thin electronic equipment such as a notebook type word processor, personal computer or the like. More particularly, the invention relates to such keyswitch device including a key top, a guide support member and a switching member, in which upward and downward movement of the key top is guide-supported by the guide support member including two link members pivotally movably connected to each other, and the switching member on which the guide support member is mounted is slidably disposed to hold the key top at an operation position when a key operation is carried out and to lock the key top at a non-operation position lower than the operation position during transport, thereby improving portability yet keeping high key operation performance.

The notebook type word processor or personal computer has recently become very popular because of its excellent portability as it can be easily carried and operated anywhere. As a result, various attempts have been made to further improve the portability of the word processor, etc.

For example, Japanese Patent Application Kokai No. Hei 5-298000 discloses a keyboard device mounted in a notebook type word processor in which the height of a key top is made variable by disposing a slide mechanism for sliding a leaf spring sheet interlockingly with opening and closing movement of a lid. The leaf spring sheet includes a return spring for resiliently supporting the key top and a contact press spring provided integral with the return spring for performing switching operation upon pushing a contact point of a membrane switch.

This Japanese Application Kokai also discloses a keyboard device mounted in a notebook type word processor or the like in which the height of a key top is made variable by disposing a shift mechanism. The shift mechanism is adapted to move a keyswitch base upwardly and downwardly, the keyswitch base vertically movably supporting the key top.

Further, Japanese Utility Model Application Kokai No. Hei 5-69831 discloses a keyswitch structure mounted in a notebook type personal computer or the like, in which when a key operation is performed, a key top supported movably upwardly and downwardly on a keyboard frame is elastically urged through a contact portion of a leaf spring to be held at a key operation position. When the personal computer is carried, a movable fulcrum member which is disposed slidably on the keyboard frame is slidingly moved to release engagement with a groove portion of the leaf spring, so that the urging of the key top by the contact portion of the leaf spring is released to lower the height of the key top.

In both the keyboard and the keyswitch structure as disclosed in the above JP references, the height of the key top can be reduced during transport to improve the portability. However, in all these keyswitches, a key support member is used to support the key top to be movably upward and downward. For example, in the keyswitch of the keyboard as described in the JP reference Hei 5-298000, the key top is supported to be movably upward and downward through a key stem portion (key support member) formed in a switch housing or a keyswitch base. Further, in the keyswitch structure as described in the JP reference Hei 5-69831, the key top is supported to be movably upward and downward through a silo (corresponding to the key stem portion) formed on the keyboard frame.

As described above, in the structure in which the key top is supported through the key stem portion in the key support member, it is generally difficult to make the keyswitch thin at key operation time. For example, whether the keyswitch can be made thinner is greatly dependent on the length of the stem portion for slidably guiding the key top. Thus, the length of the stem portion is limited to a prescribed value to accomplish the thinning of the keyswitch. On the other hand, a stroke amount of the key top must be set to a sufficient length to keep excellent operation performance of the key top. Accordingly, if the stroke amount of the key top is set to be large while the keyswitch is thinned, the slide length of the stem portion becomes insufficient because the length of the stem portion cannot be set to be larger than a prescribed value. Therefore, when the key top is pressed, unwanted twisting force may be generated between the key top and the stem portion or abnormal sliding friction results therebetween, so that the key top cannot be smoothly operated.

Various proposals have been hitherto made to solve the above problem. For example, in Japanese Patent Application Kokai No. Hei 5-342943 and U.S. Pat. No. 5,280,147, a push button switch and a keyswitch device are described in which a key top is guide-supported through a guide support member including two link members to be mutually rotatable. The guide support member is directly secured to a housing or a holder member having no stem portion. In this kind of switch, since no stem portion is formed in the housing or holder member to which the guide support member of the key top is secured, there is no restriction based on the length of the stem portion. Thus, the thinning of the whole construction of the switch can be promoted.

When the switch as described in the JP reference Hei 5-342943 and U.S. Pat. No. 5,280,147 is used in the notebook type word processor or the like, a mechanism for further lowering the height of the key top during transport is preferable to improve the portability. However, the slide mechanism of the leaf spring sheet as described in the JP reference Hei 5-298000 and the slide mechanism of the movable fulcrum member as described in the JP reference Hei 569831 have been proposed in view of the specific structure of their respective keyswitches. Thus, these mechanisms cannot be directly applied to the switches described in the JP reference Hei 5-342943 and the U.S. Pat. No. 5,280,147 in which the upward and downward movement of the key top is guide-supported by the guide support member including two link members.

SUMMARY OF THE INVENTION

In order to further reduce the height of the key top during transport in a keyswitch device in which vertical motion of the key top is guide-supported by the guide support member including two link members, a parent U.S. patent application Ser. 08/495,076 filed Jun. 27, 1995 discloses a keyswitch device including a guide-support member, a holder member, a switching member, and a circuit board. The guide support member includes two link members pivotally connected to each other for guide-supporting the movement of the key top in a vertical direction. The holder member has an attachment portion for attaching the guide-support member to the holder member. The switching member is disposed below the guide-supporting member for mounting the guide-support member, and is adapted to perform switching operation in accordance with the vertical displacement of the key top. The circuit board is adapted to mount thereon the switching member. The circuit board serves as a slide member. The switching member is disposed to be slidable to thereby hold the key top at the operation position and to lock the key top at the non-operation position lower than the operation position.

However, in the parent U.S. Patent application, the holder member which has the attaching portion for attaching the guide-support member must have a given physical thickness. Therefore, the keyswitch device of the parent U.S. Patent application still encounters difficulty in reduction in height of the key top during transport. This problem is the same as that of the JP reference Hei 5-298000 in which the keyswitch base has a given physical length, the keyswitch base being vertically movable upon sliding operation of the slide bar for changing height and stroke amount of the keyboard. Further, this problem is also the same as that of the JP reference Hei 5-69831 in which the keyboard frame has a given physical length, the keyboard frame having a key top attachment hole adapted to be slidably engaged with a guide post provided at a rear surface of the key top.

Furthermore, in the above described prior art references and in the parent U.S. Patent Application, the height of the all key tops of the keyboard is concurrently changed from their lower non-operating positions to upper operating positions. However, in a specific key inputting operation, there are several keys to which the key operation should not be made, or there are several keys of out service depending on a specific operation mode. In such a case, it is desirable that unwanted keys or non-service keys still have their lower non-operating positions in spite of the raising operation of the key tops in order to avoid mistaking key inputting operation or unwanted operation.

It is therefore, an object of the present invention to provide a keyswitch device having a guide-support member which includes two link members for guiding vertical movement of the key top, the keyswitch device being capable of further reducing the height of the key top at a locked non-operating position during transport, yet providing a sufficient operability of the key top during operation at the operating position.

Another object of the present invention is to provide the keyswitch device in which height of a key top of a specific keyswitch can be varied or controlled independently.

These and other objects of the present invention will be attained by providing a keyswitch device including a key top, a support plate, a switching pattern, a guide support member, and a switching member. The key top has an upper finger touching face and a lower face to which first and second holding portions are provided. The support plate is disposed beneath the key top. The support plate has an upper portion provided with a third holding portion in confrontation with the first holding portion and a fourth holding portion in confrontation with the second holding portion. The switching pattern is provided on the support plate. The guide support member supports the key top for moving the key top vertically toward and away from the switching pattern. The guide support member includes a first link member held by the first and fourth holding portions and a second link member pivotally connected to the first link member and held by the second and third holding portions. The switching member performs a switching operation in accordance with the movement of the key top. The switching member is movable to an operating position beneath the key top via the guide support member to make electrical connection of the switching pattern and to a non-operating position removed from beneath the key top and disengaged from the guide support member.

In another aspect of the present invention, there is provided a key board including a plurality of keyswitch devices and at least one slide mechanism. Each keyswitch device includes a key top, a support plate disposed beneath the key top, a switching pattern provided on the support plate, a guide support member supporting the key top for moving the key top vertically toward and away from the switching pattern, the guide support member comprising a first link member and a second link member pivotally connected to the first link member, the first and second link members having one end connected to the key top, and a switching member performing a switching operation in accordance with the movement of the key top to make electrical connection of the switching pattern. The at least one slide mechanism is adapted for selectively moving the key top to an operating position where the guide support member is mounted on the switching member and to a non-operating position where the guide support member is disengaged from the switching member. The slide mechanism is provided with respect to a desired keyswitch device.

DETAILED DESCRIPTION OF THE PREFERRED EMBODIMENTS

Figure 1:
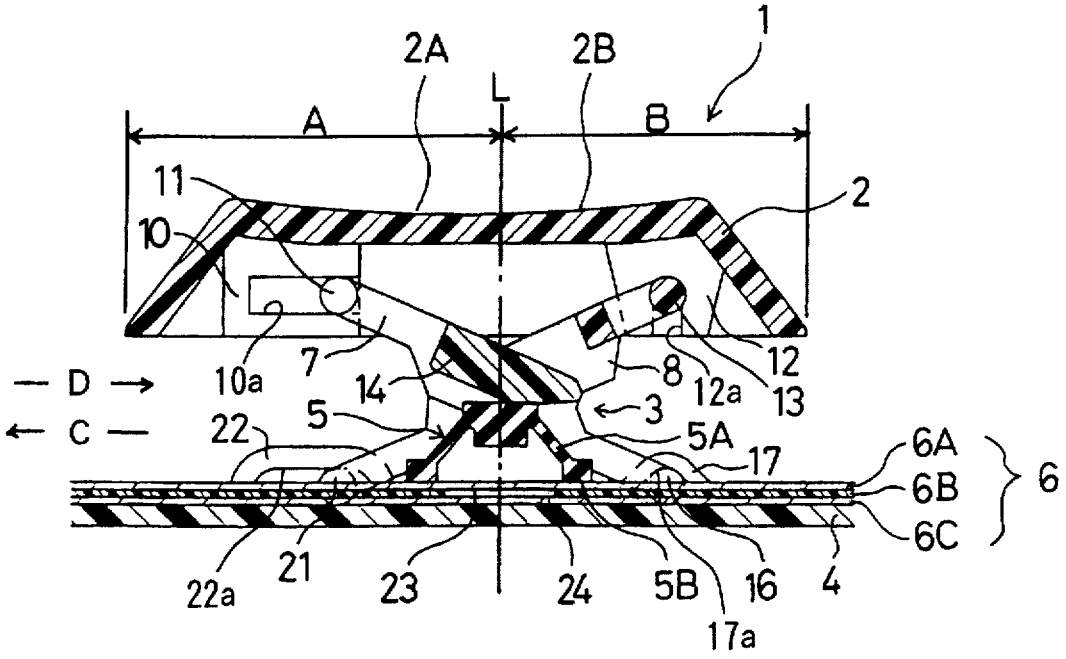
FIG. 1 is a cross-sectional view showing a keyswitch device according to a first embodiment when a key top is located at an operation position.

A keyswitch device according to a first embodiment of the present invention will be described with reference to FIGS. 1 through 7. Details of each component of the keyswitch device are shown in FIGS. 1 through 4. In FIG. 1, the keyswitch device 1 generally includes a key top 2, a guide support member 3 for guiding an upward and downward movement of the key top 2 while keeping horizontal orientation of the key top 2, a support plate 4 for holding the guide support member 3, a rubber spring 5, and a circuit board 6 mounted on the support plate 4 and to which the rubber spring 5 is fixed at a position below the guide support member 3.

The key top 2 is formed of ABS resin or the like, and characters, symbols etc. are printed on the upper surface of the key top 2 to specify the key top 2. The key top 2 is divided into a slide-connection portion 2A (left-hand portion in FIG. 1) and a pivot-connection portion 2B (right-hand portion in FIG. 1) with respect to a vertical reference line L passing through a pivot shaft 9 of a first link member 7 described later. The length A of the slide-connection portion 2A is set to be longer than the length B of the pivot connection portion B. A pair of first holding portions 10 each formed with an elongated horizontal groove 10*a* are formed on the back surface of the slide-connection portion 2A of the key top 2. Further, a pair of second holding portions 12 each formed with a circular hole 12*a* are formed on the back surface of the pivot-connection portion 2B of the key top 2. Incidentally, in FIG. 1, only one of the first holding portions 10 and only one of the second holding portions 12 are illustrated.

Figure 2:
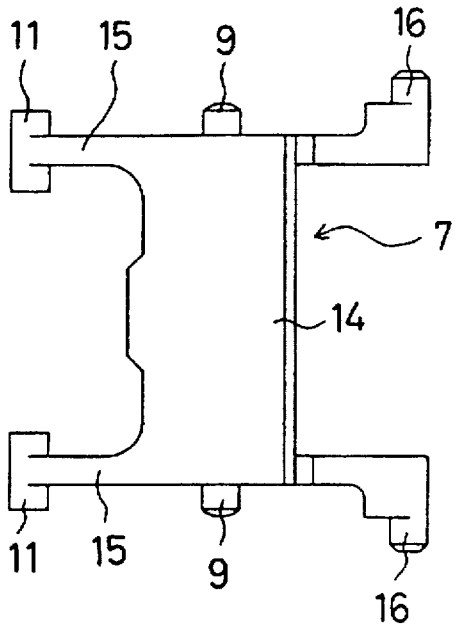
FIG. 2 is a plan view showing one link member according to the first embodiment.

The guide support member 3 is provided by the combination of first and second link members 7 and 8 pivotally connected to each other at the pivot shaft 9. The first link member 7 is best shown in FIG. 2. The first link member 7 is preferably formed of polyacetal resin or the like and has a substantially H-shape in plan view. The first link member 7 includes a base portion 14 and a pair of plate portions 15 formed at both sides of the base portion 14. A first slide pin 11 is provided at one end (left-handed end in FIG. 2) of each plate portion 15 so as to extend outwardly. Each first slide pin 11 is slidingly engageable with the elongated groove 10*a* of the first holding portion 10.

A first holding pin 16 is provided at the other end (right-hand end in FIG. 2) of each plate portion 15 so as to extend outwardly. Each first holding pin 16 is rotatably held by a fourth holding portion 17 formed in the support plate 4 described later. The pivot shaft 9 is provided substantially at the central position of each plate portion 15 so as to project outwardly. The pivot shaft 9 is rotatably engaged with the second link member 8.

Figure 3:
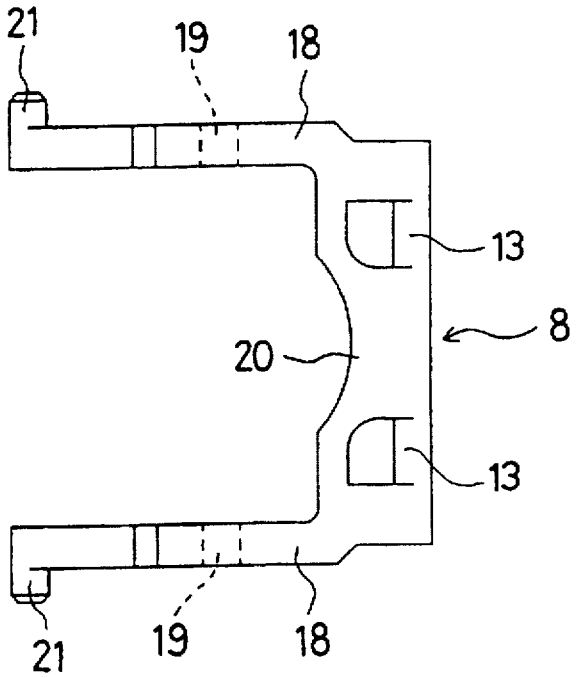
FIG. 3 is a plan view showing another link member according to the first embodiment.

The second link member 8 is best shown in FIG. 3. Like the first link member 7, the second link member 8 is preferably formed of polyacetal resin or the like, and it has a substantially U-shape in plan view. The second link member 8 includes a base portion 20 and a pair of plate portions 18 formed at both sides of the base portion 20. A second slide pin 21 is provided at one end (left-hand end in FIG. 3) of each plate portion 18 so as to project outwardly. Each second slide pin 21 is slidably engaged with a third holding portion 22 of the support plate 4 described later. Second holding pins 13 are provided at the base portion 20. Each second holding pin 13 is rotatably held by each second holding portion 12 provided at the pivot-connection portion 2B of the key top 2. Each plate portion 18 has an intermediate portion formed with a pivot hole 19. Each pivot shaft 9 of the first link member 7 is rotatably supported in the pivot hole 19.

As described above, the guide support member 3 is constructed by rotatably inserting the pivot shaft 9 of the first link member 7 into the pivot hole 19 of the second link member 8 so as to be mutually opened and closed to provide a scissors-type linkage. With this arrangement, the following four distances are set to equal to one another: the distance from the center of the pivot shaft 9 of the first link member 7 to the center of the first slide pin 11; the distance from the center of the pivot shaft 9 to the center of the first holding pin 16; the distance from the center of the pivot hole 19 of the second link member 8 to the center of the second slide pin 21; and the distance from the center of the pivot hole 19 to the center of the second holding pin 13.

Next the support plate 4 will be described with reference to FIGS. 1 and 4. The support plate 4 is formed of a metal such as aluminum, and is provided for each keyswitch device. Accordingly, when the keyswitch device 1 according to this embodiment is applied to a keyboard equipped with a plurality of the keyswitches, respective support plates 4 are integrally formed with one another in correspondence to the respective keyswitch devices 1 to provide the keyboard.

Figure 4:
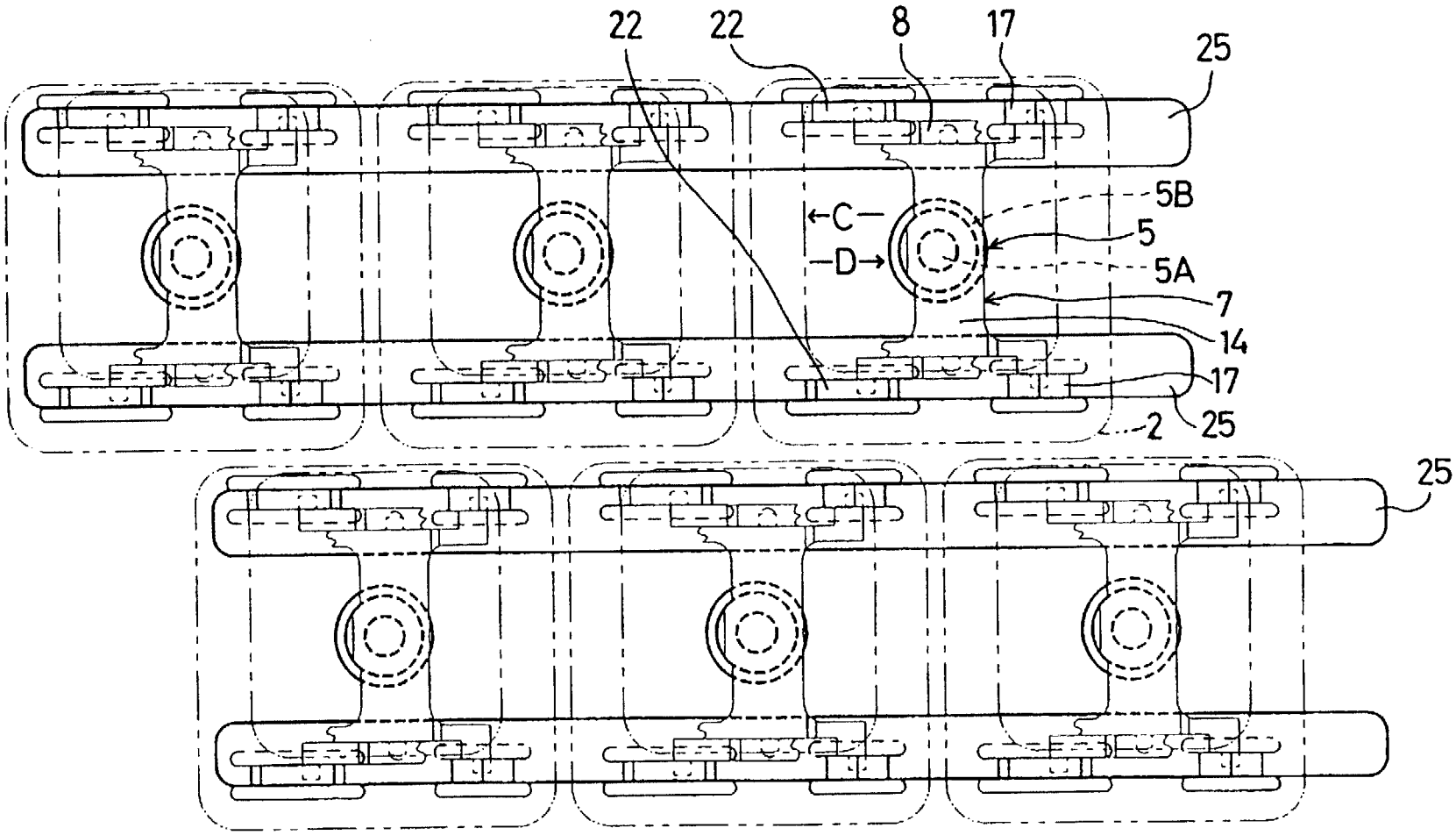
FIG. 4 is a bottom view showing a geometrical relationship between a support plate and a rubber spring at the operation position prior to sliding movement of a circuit board according to the first embodiment, when a plurality of the keyswitch devices according to the first embodiments are arranged to provide a keyboard.

As shown in FIGS. 1 and 4, the support plate 4 has upwardly projecting pair of third holding portions 22 per each keyswitch device. Each third holding portion 22 confronts the first holding portion 10 of the key top 2. The third holding portion 22 has an elongated slot 22*a* to slidably engage the second slide pin 21 of the second link member 8. Further, the support plate 4 has upwardly projecting a pair of fourth holding portions 17 per each keyswitch device. Each fourth holding portion 17 confronts the second holding portion 12 of the key top 2. The fourth holding portion 17 has a circular hole 17*a* to rotatably support the first holding pin 16 of the first link member 7. A plurality of the third and fourth holding portions 22 and 17 are aligned with one another to provide the keyboard.

The circuit board 6 will next be described with reference to FIGS. 1 and 4. The circuit board 6 includes a first flexible circuit board 6A, a second flexible circuit board 6C and a spacer 6B interposed between the first and second flexible circuit boards 6A and 6C. The first flexible circuit board 6A is constituted by a flexible film formed of polyethylene terephthalate (PET) or the like and a prescribed circuit pattern formed at the lower surface of the flexible film. The second flexible circuit board 6C is constituted by a flexible film formed of polyethylene terephthalate (PET) or the like and a prescribed circuit pattern formed at the upper surface of the flexible film. The spacer 6B is adapted to prevent a switching circuit portion of the first flexible circuit board 6A from being in contact with a switching circuit portion of the second flexible circuit board 6C during non-operation state. The spacer 6B is formed with holes at positions corresponding to the switching circuit portion. The lower surface of the circuit board 6, i.e., the lower surface of the second flexible circuit board 6C is supported on the support plate 4.

Further, the circuit board 6 has elongated slide slots 25 extending in a direction of arrays of the third and fourth holding portions 22 and 17 of the support plate 4, so that the third and fourth holding portions 22 and 17 can pass through the thickness of the circuit board 6. At least one of the third and fourth holding portions 22 and 17 is in sliding contact relation with the elongated slide slot 25. Therefore, sliding movement of the circuit board 6 on the support plate 4 is guided by the sliding contact relation. For providing a keyboard, a plurality of pairs of the third and fourth holding portions 22 and 17 are provided which are aligned with one another in a straight line.

As shown in FIGS. 1 and 4, the rubber spring 5 is fixedly secured onto the circuit board 6 at a position below the pivotal connection between the pivot shaft 9 and the pivot hole 19. The rubber spring 5 is formed of elastic rubber material, such as silicon rubber, EPDM or the like. The rubber spring 5 has a conical dome portion 5A and an outer rim or edge portion 5B at the bottom of the dome portion 5A. At the top surface of the dome portion 5A, the base portion 14 of the first link member 7 is mounted. With this arrangement, the guide support member 3 consisting of the first and second link members 7 and 8 is elastically supported through the dome portion 5A of the rubber spring 5. Since the rubber spring 5 is fixed on the circuit board 6, the rubber spring 5 is moved together with the sliding movement of the circuit board 6, which will be described in detail later.

The first flexible circuit board 6A has a first switching electrode 23, and the second flexible circuit board 6C has a second switching electrode 24 at positions corresponding to the dome portion 5A of the rubber spring 5. The first and second switching electrodes 23 and 24 are normally spaced away from each other by the spacer 6B. However, by the depression of the key top 2, the dome portion 5A is elastically compressed to press the first flexible circuit board 5A. Thus, the first switching electrode 23 is brought into contact with the second switching electrode 24 to cause short circuit, thereby performing switching operation.

Next, a method of fabricating the keyswitch device 1 will be described. First, the pivot shaft 9 of the first link member 7 is engaged with the pivot hole 19 of the second link member 8 to fabricate the guide support member 3. Next, the circuit board 6 is mounted on the support plate 4 in such a manner that the third and fourth holding portions 22 and 17 project through the elongated slide slots 25 of the support plate 4. Then, each second slide pin 21 of the second link member 8 is held by each third holding portion 22 of the support plate 4, and each first holding pin 16 of the first link member 7 is snappingly engaged with each fourth holding portion 17 of the support plate 4. With this state, the guide support member 3 is held on the support plate 4, and further, the circuit board 6 can be slidably arranged on the support plate 4 without disengagement therefrom.

Then, the key top 2 is set above the guide support member 3, and each first slide pin 11 of the first link member 7 is held by each first holding portion 10 at the slide-connection part 2A of the key top 2, and each second holding pin 13 of the second link member 8 is snappingly engaged with each second holding portion 12 at the pivot-connection part 2B of the key top 2. Thus, the keyswitch device 1 can be fabricated. Upon completion of the fabrication of the keyswitch device 1, the base portion 14 of the first link member 7 is mounted on the dome portion 5A of the rubber spring 5. Therefore, the key top 2 is upwardly urged by the elastic force of the rubber spring 5 together with the guide support member 3 and held at a non-depressed position shown in FIG. 1. Incidentally, in this instance, the circuit board 6 has a slide position indicated by an arrow D in FIG. 1.

Figure 5:
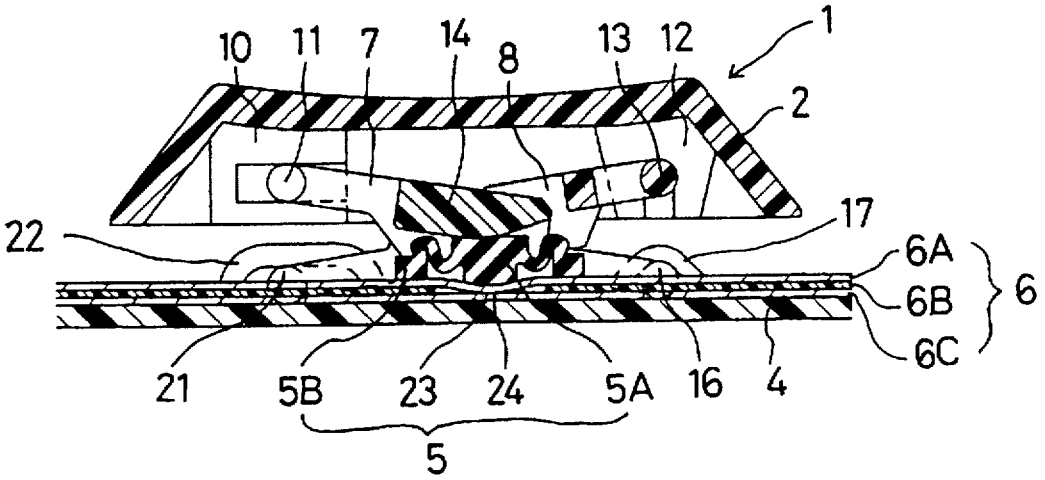
FIG. 5 is a cross-sectional view showing the depressed position of the keyswitch device according to the first embodiment.

Next, the switching operation of the keyswitch device 1 thus constructed is described with reference to FIGS. 1 through 5. FIGS. 1 and 5 show non-depressed and depressed position of the key top 2, respectively. Further, the print circuit board 6 is shifted to the position indicated by the arrow D in FIG. 1.

When the key top 2 is depressed from the state shown in FIG. 1, each first sliding pin 11 of the first link member 7 of the slide guide member 3 is slid to the left side in the first holding portion 10, and the first holding pin 16 is rotated in counterclockwise direction in the fourth holding portion 17. At the same time, the second holding pin 13 of the second link member 8 of the slide guide member 3 is rotated in a clockwise direction in the second holding portion 12, and the second slide pin 21 is slid to the left side in the third holding portion 22. At this time, the key top 2 is shifted downwardly while kept in a horizontal posture regardless of the pressing position of the key top 2 by a cooperating action between each first and second link members 7 and 8.

Following the downward shift of the key top 2, the base portion 14 of the first link member 7 gradually presses the dome portion 5A of the rubber spring 5. When the pressing force exceeds a predetermined limit, the dome portion 5A is buckled with click touch. Through the buckling, the dome portion 5A presses down the first switching electrode 23 of the first flexible circuit board 6A, so that the first switching electrode 23 is brought into contact with the second switching electrode 24 of the second flexible circuit board 6C through passage of the spacer 6B. Thus, electrical short circuit occurs to provide ON state to perform ON-switching operation.

Upon release of the press of the key top 2, the base portion 14 of the first link member 7 is upwardly urged through the elastic restoration force of the rubber spring 5. At this time, each first sliding pin 11 of the first link member 7 is slid to the right side in the first holding portion 10, and the first holding pin 16 is rotated in the clockwise direction in the fourth holding portion 17. At the same time, the second holding pin 13 of the second link member 8 is rotated counterclockwise in the second holding portion 12, and the second sliding pin 21 is slid to the right side in the third holding portion 22. Following this motion, the dome portion 5A of the rubber spring 5 is gradually returned to its original state. During this restoration, the first switching electrode 23 is moved away from the second switching electrode 24 to provide a OFF state, thereby performing an OFF-switching operation. The key top 2 is returned to the original non-depressed state shown in FIG. 1 through the elastic force of the rubber spring 5. In this case, as during depression, the key top 2 is upwardly shifted while being maintained in the horizontal posture by the cooperative action between the first and second link members 7 and 8.

Figure 6:
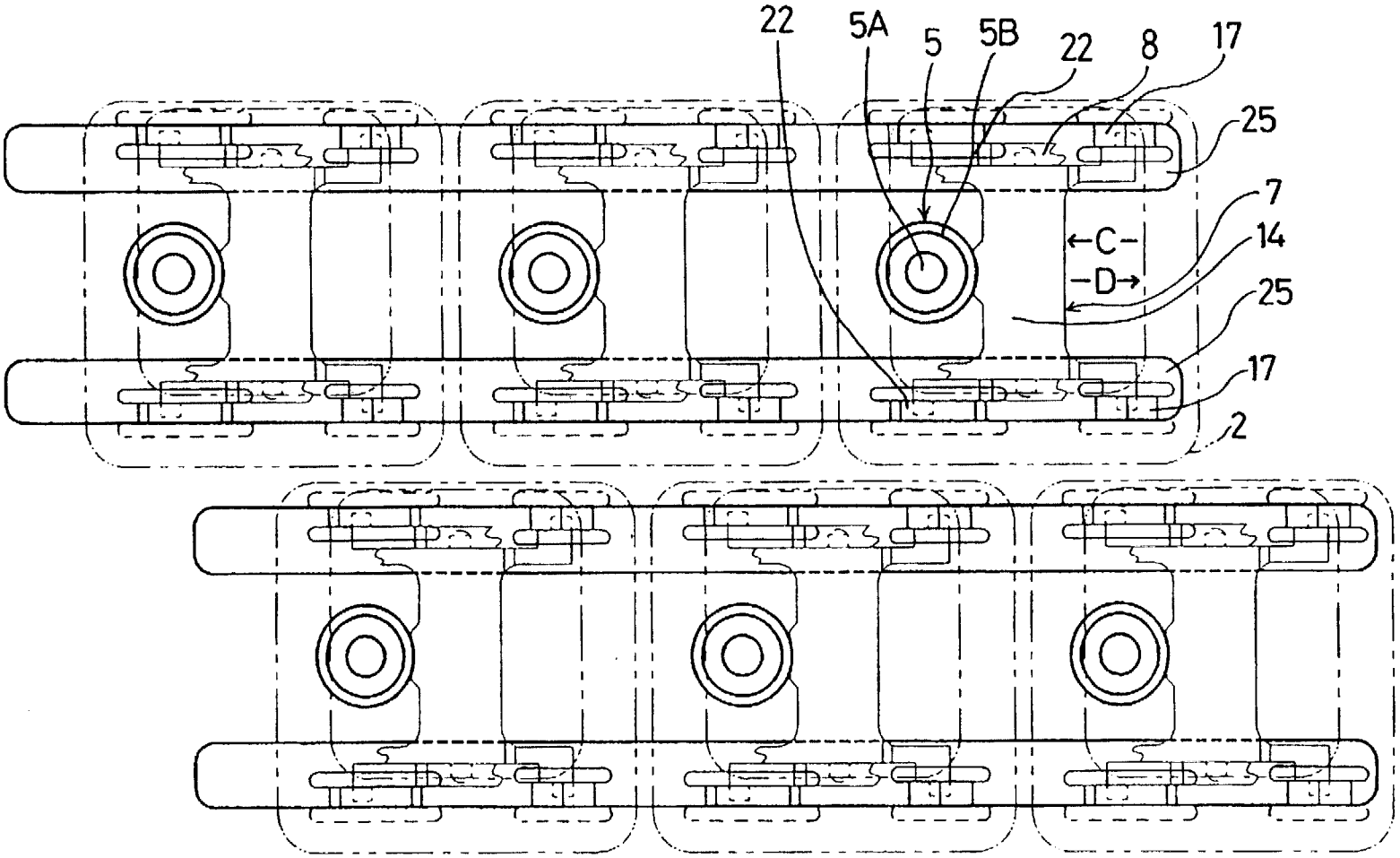
FIG. 6 is a bottom view showing a geometrical relationship between the support plate and the rubber spring at a non operation position after sliding movement of the circuit board according to the first embodiment, when the plurality of the keyswitch devices according to the first embodiments are arranged to provide the keyboard.

Next, will be described with reference to FIGS. 6 and 7 an operation when the circuit board 6 is slid in the opening direction of each first link member 7 and the second link member 8 to lower the height of the key top 2 for the purpose of improving portability of the keyswitch device 1. It is assumed that the support plate 4 and the circuit board 6 together with the rubber spring 5 are in the state shown in FIGS. 1 and 4 before the sliding operation of the circuit board 6.

First, in the state shown in FIG. 4, the circuit board 6 is shifted as much as possible in the direction indicated by an arrow C. During the sliding movement of the circuit board 6, the dome portion 5A of the rubber spring 5 is gradually detached from the base portion 14 of the first link member 7. When the base portion 14 abuts against the conical wall portion of the dome portion 5*a*, the first and second link members 7 and 8 which have been upwardly urged by the elastic force of the rubber spring 5 are mutually folded up through the pivot shaft 9 and the pivot hole 19. Following this operation, the height of the key top 2 is gradually lowered from the state shown in FIG. 1. When the base portion 14 of the first link member 7 is completely separated from the dome portion 5A, the first link member 7 and the second link member 8 are lain on the circuit board 6 while being completely folded up as shown in FIG. 7. At the same time, the key top 2 is located at the lowest position because no elastic force of the rubber spring 5 is applied to the key top 2.

When the base portion 14 of the first link member 10 is completely separated from the dome portion 5A of the rubber spring 5, the rubber spring 5 is completely accommodated below a contour of the slide-connecting portion 2A of the key top 2. Thus, when the rubber spring 5 is slid to the non-operating position of the key top 2 together with the circuit board 6, the rubber spring 5 is slid toward the slide-connection portion 2A, which is designed to be longer than the pivot-connecting portion 2B of the key top 2, and is accommodated at the lower side of the slide connecting portion 2A. Therefore, the rubber spring 5 can be surely prevented from being accommodated while abutting against the key top 2 with the deformed shape. Accordingly, characteristic of the rubber spring 5 can be preserved for a prolonged duration. Further, the rubber spring 5 is not in direct contact with neighboring components except the slide guide member 3, smooth sliding movement can be obtained.

Figure 7:
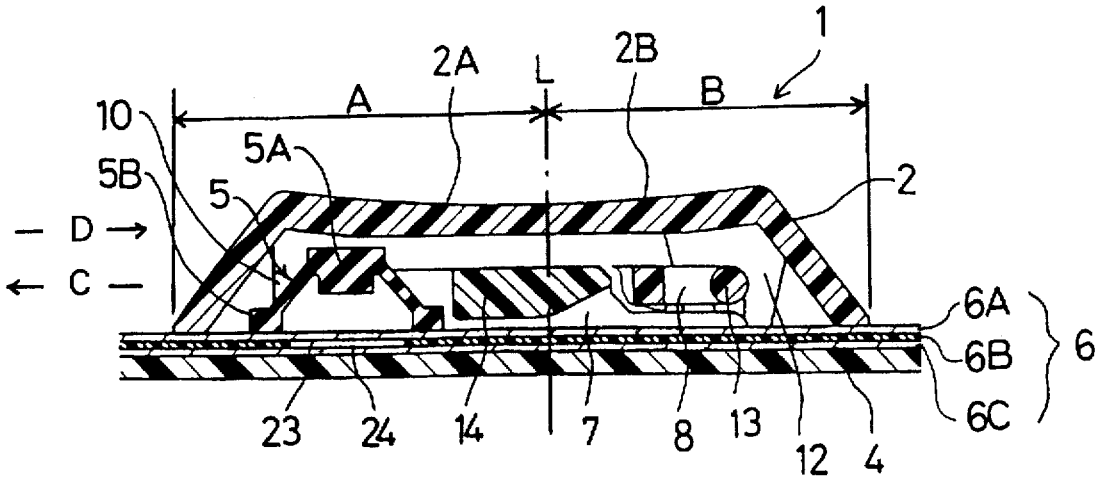
FIG. 7 is a cross-sectional view showing the non operating position of the key top according to the first embodiment.

When the keyswitch device 1 is used, in order to return the key top 2 to the operation position, according to the operation inverse to the above operation, the circuit board 6 is shifted as much as possible to the direction indicated by the arrow D in FIG. 7. During the sliding move ment of the circuit board 6, the dome portion 5A of the rubber spring 5 is gradually moves under the lower side of the base portion 14 of the first link member 7, and finally is mounted at the top surface of the dome portion 5A. With this operation, the folded first and second link members 7 and 8 are returned to their original states, and the height of the key top 2 gradually increases, so that it is returned to the original operational position shown in FIG. 1. For facilitating the movement of the dome portion 5A under the lower side of the first link member 10, in other words, for facilitating sliding motion between the dome portion 5A and the base portion 14, the upper circumferential edge portion of the dome portion 5A and an edge line of the base portion 14 are preferably formed with chamfered portions.

Figure 8:
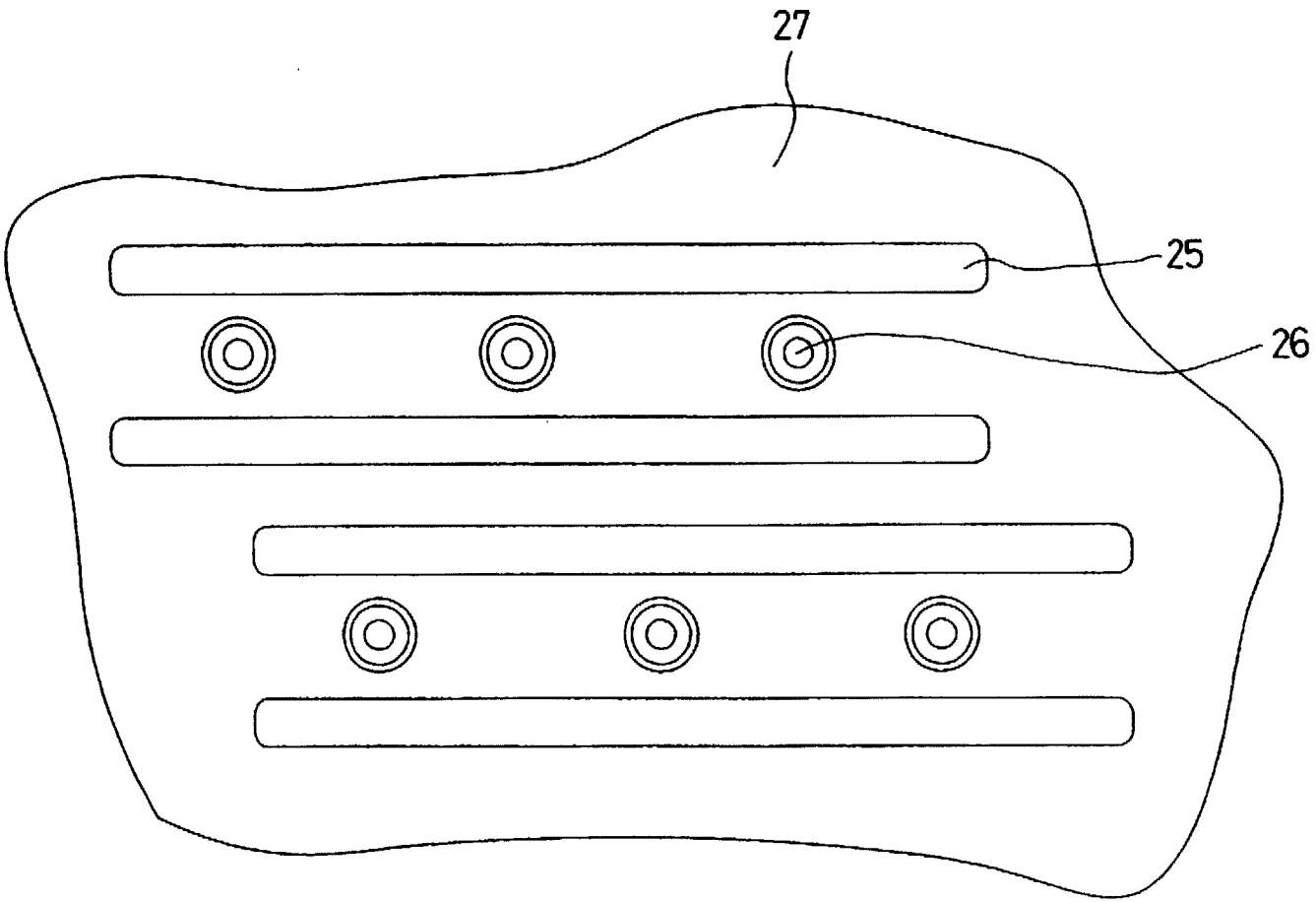
FIG. 8 is a plan view showing an elastomers slide member integrally provided with an elastomers spring used in a keyswitch device according to a second embodiment of the present invention.

A switching device according to a second embodiment of the present invention will next be described with reference to FIG. 8. In the second embodiment, an elastomers slide member 27 is provided. The elastomers slide member 27 is integrally provided with an elastomers spring 26 and is formed with elongated slots 25. More specifically, instead of the rubber spring 5 of the first embodiment, the elastomers spring 26 is used. Further, instead of the first flexible circuit board 6A and the spacer 6B of the first embodiment, the elastomers slide member 27 is used. Similar to the first embodiment, the support plate 4 has a pair of third holding portions 22 and fourth holding portions 17 per each switching device, and a second flexible circuit board 6C is mounted on the support plate 4 similar to the first embodiment. The second flexible circuit board 6C has a pair of fixed contact patterns (not shown) per each switching device.

The elastomers slide member 27 is slidably mounted on the support member 4. The sliding movement of the elastomers slide member 27 is guided by the contact between one of the third and fourth holding portions 22 or 17 with the elongated slots 25. The elastomers spring 26 has a movable electrode (not shown) at a position corresponding to the pair of fixed contact patterns of the second flexible circuit board 6C.

For assembling the switching device, each second slide pin 21 of the second link member 8 is held by each third holding portion 22 of the support plate 4, and each first holding pin 16 of the first link member is snappingly engaged with each fourth holding portion 17 of the support plate 4. Further, the key top 2 is set above the guide support member 3, and each first slide pin 11 of the first link member 7 is held by each first holding portion 10 at the slide-connection part 2A of the key top 2, and each second holding pin 13 of the second link member 8 is snappingly engaged with each second holding portion 12 at the pivot-connection part 2B of the key top 2. Thus, in the second embodiment, the numbers of the parts or components can be reduced, and frictional resistance can be lowered because the sliding contact occurs between the components formed of the materials different from each other. Further, because of the elastomers material is used for the sliding member 27, its elongation can be prevented during sliding movement thereof.

As described above, the keyswitch device according to the first and second embodiments is of the type wherein the key top 2 is vertically movably supported on the support plate 4 through the guide support member 3 constituted by two link members 7 and 8 pivotally connected to each other. In the keyswitch device, an additional holder member is not provided for holding each one end of the first and second link members 7 and 8, but the support member 4 integrally provides third and fourth holding portions 22 and 17 for holding each one end of the first and second link members 7 and 8. Therefore, entire thickness of the keyswitch device can be reduced.

Further, the circuit board 6 fixed with the rubber spring 5 which can mounts thereon the base portion 14 of the first link member 7 is slidably movable on the support plate 4 in the direction for opening and closing the first and second link members 7 and 8 between the operation position and non-operation position of the key top 2. During transport, the circuit board 6 is slidingly moved to the non-operation position for moving the rubber spring 5 to its non-operation position offset from the guide support member 3. As a result, upward urging force of the rubber spring 5 is not imparted on the guide support member, thereby folding up the first and second link members 7, 8 to lower the height of the key top 2. Thus, further thinning of the switching device 1 can result because of no provision of the holder member.

Furthermore, the circuit board 6 is slidingly moved in the direction of array of the third and fourth holding portions 22 and 17, and at least one of the third and fourth holding portions 22 and 17 serves as the guide for guiding sliding movement of the circuit board 6. Thus, simple arrangement results yet performing smooth sliding movement without additional guide member for exclusively guiding the sliding movement of the circuit board 6.

Furthermore, since the circuit board 6 is interposed between the lower support plate 4 and the upper hold pins 16 and slide pins 21, floating of the circuit board 6 can be restrained by these pins 16, 21 during sliding movement of the circuit board 6.

A keyswitch device according to a third embodiment of the present invention will be described with reference to FIGS. 9 through 13 wherein like parts and components are designated by the same reference numerals and characters as those shown in the first embodiment. The third embodiment pertains to a modification to the first embodiment. That is, members corresponding to the second flexible circuit board 6C and the spacer 6B of the first embodiment are formed by printing on the support plate 4, and a member corresponding to the first flexible circuit board 6A of the first embodiment serves as a slide member to provide a simple arrangement. Remaining arrangement is the same as that of the first embodiment.

Figure 9:
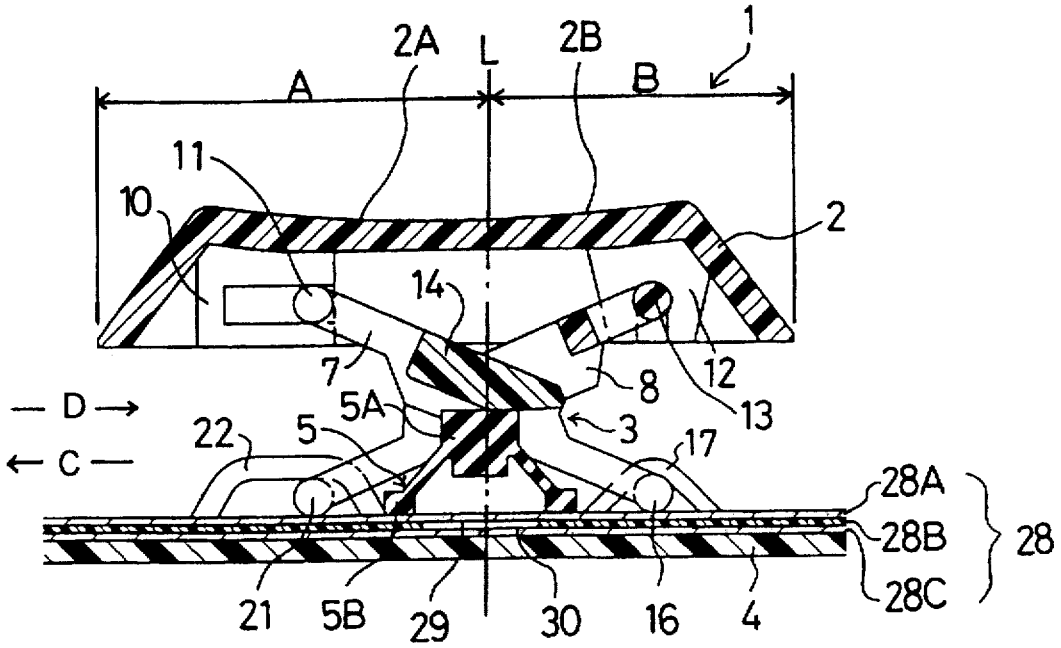
FIG. 9 is a cross-sectional view showing a keyswitch device according to a third embodiment when a key top is located at an operation position.

In FIG. 9, a circuit pattern portion 28 is provided. The circuit pattern portion 28 includes a print circuit portion 28C, a printed spacer 28B and a slide member 28A. In the print circuit portion 28C, a pair of fixed contact patterns 30 for each keyswitch device 1 are printed on the support plate 4. Incidentally, if the support plate 4 is formed of a metal, the support plate 4 is provisionally subjected to insulation treatment, and then, the printing is effected. The printed spacer 28B is provided on the circuit pattern portion 28C in such a manner that the pair of the fixed contact patterns 30 are exposed to atmosphere. The slide member 28A is disposed slidably on the printed spacer 28B. The slide member 28A has a lower surface provided with movable electrodes 29 each corresponding to each pair of the fixed contact patterns 30. Further, the rubber spring 5 is attached to the upper surface of the slide member 28A. The printed spacer 28B is formed of thermosetting resin or acrylic UV setting resin those providing low frictional resistance for providing smooth sliding movement of the slide member 28A having the movable electrodes 29. Further, as shown in FIG. 9, the slide member 28A is properly pressed by the first holding pin 16 of the first link member 7 and the second slide pin 21 of the second link member 8. Accordingly, floating of the slide member 28A can be prevented.

Figure 10:
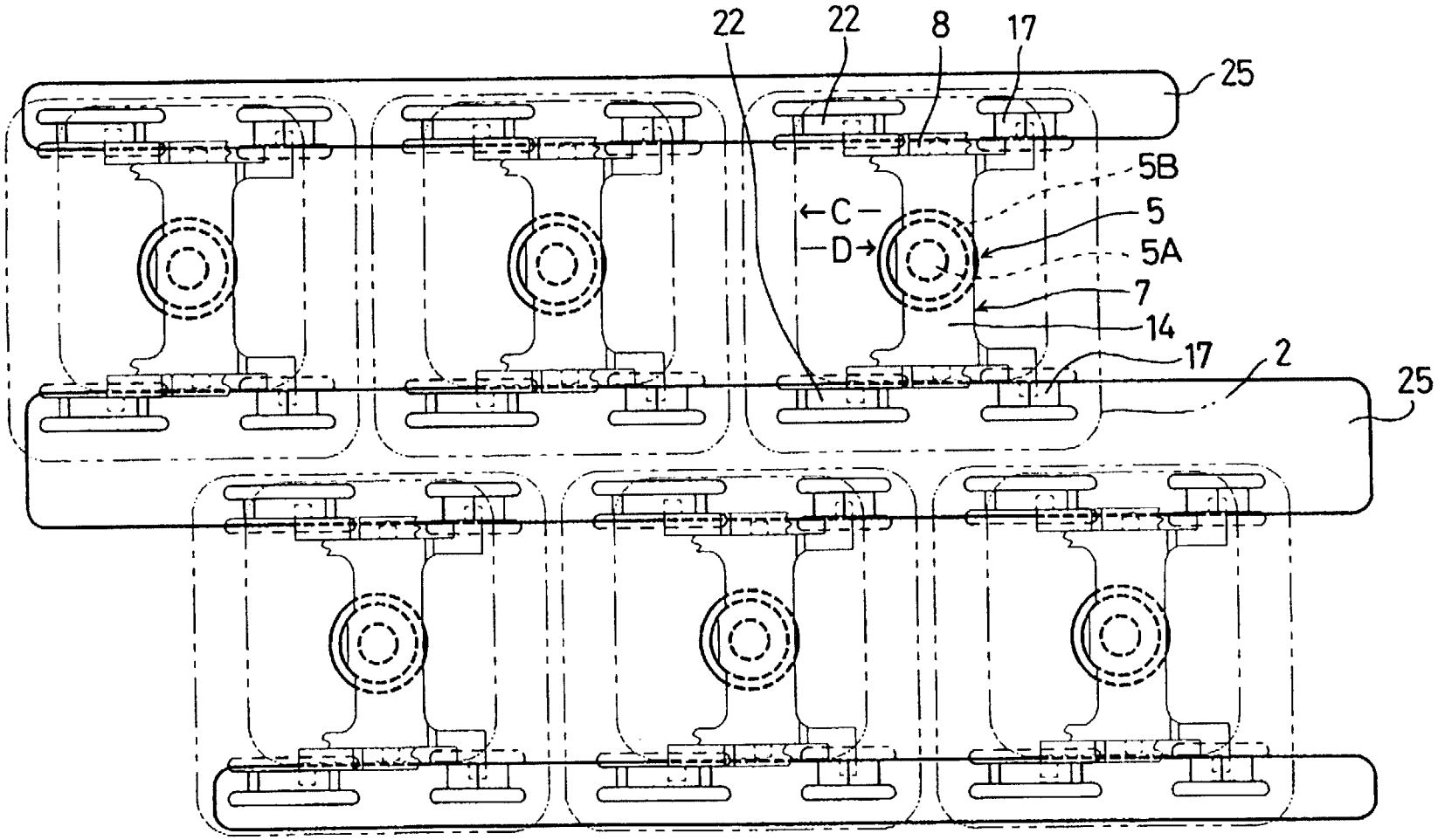
FIG. 10 is a bottom view showing a geometrical relationship between a support plate and a rubber spring at the operation position prior to sliding movement of a circuit board according to the third embodiment, when a plurality of the keyswitch devices according to the third embodiments are arranged to provide a keyboard.
Figure 12:
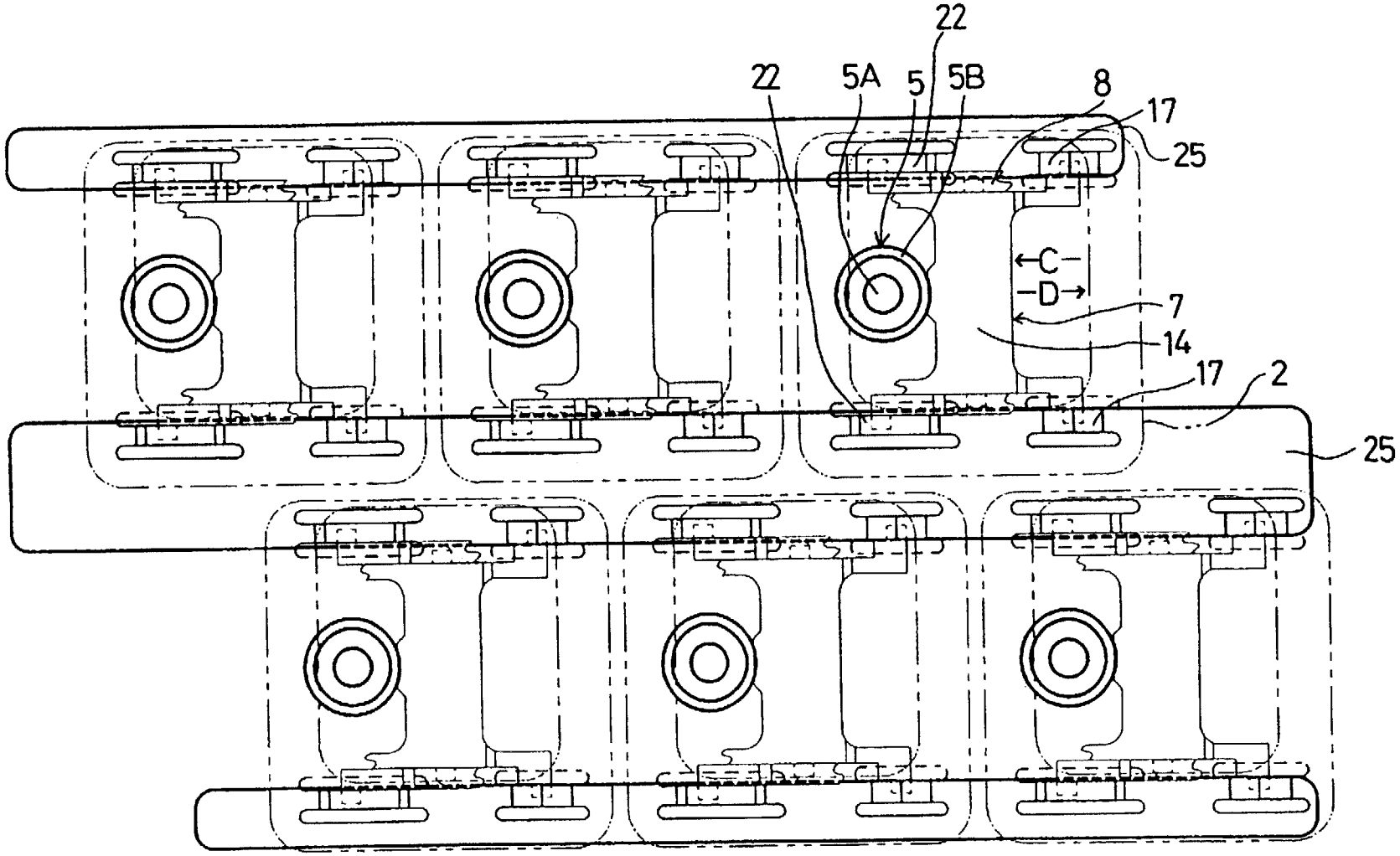
FIG. 12 is a bottom view showing a geometrical relationship between the support plate and the rubber spring at a non operation position after sliding movement of the circuit board according to the first embodiment, when the plurality of the keyswitch devices according to the third embodiments are arranged to provide the keyboard.

As shown in FIGS. 10 and 12, the slide member 28A is formed with elongated slots 25 for allowing the arrays of the third and fourth holding portions 22 and 17 of the support plate 4 to be movable. In this case, at least one of the third and fourth holding portions 22 or 17 is in contact with the wall of the elongated slots 25. Therefore, the sliding movement of the slide member 28A is guided by the contact relation without providing a guide member. Further, in the third embodiment, width of the elongated slots 25 is not equal to one another contrary to the first embodiment. To be more specific, when a plurality of the keyswitch device are arrayed for providing a keyboard, the horizontal arrays of the key tops 2 are juxtaposed as shown in FIGS. 10 and 12. In this case, the first and third elongated slots 25 have small width whereas the second elongated slot 25 has a wide width so as to guide both the third and fourth holding portions 22 and 17 of the first array of the keyswitch device and the second array of the keyswitch device. The third and fourth holding portions of the first array of the keyswitch device are guided by the upper longitudinal wall of the wide slot 25, and the third and fourth holding portions of the second array of the keyswitch device are guided by the lower longitudinal wall of the wide slot 25.

Figure 11:
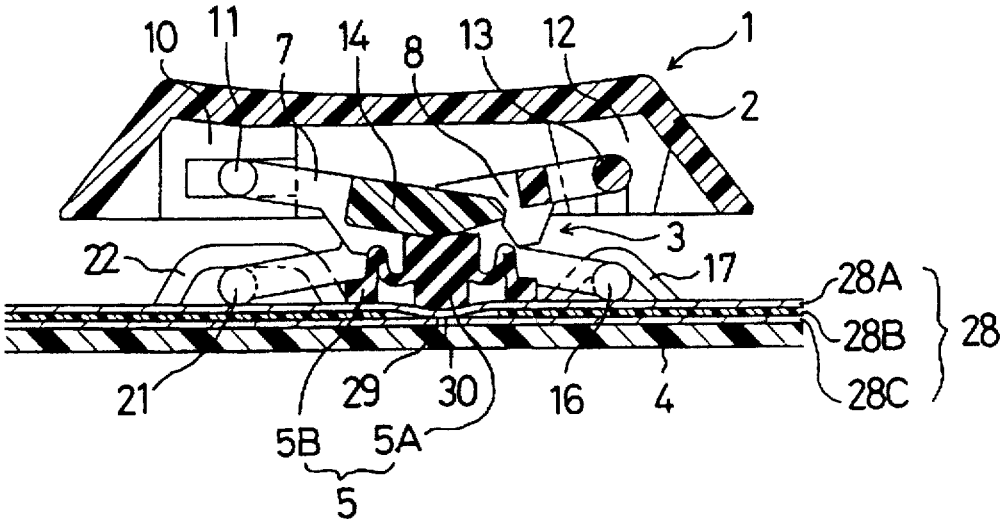
FIG. 11 is a cross-sectional view showing the depressed position of the keyswitch device according to the third embodiment.
Figure 13:
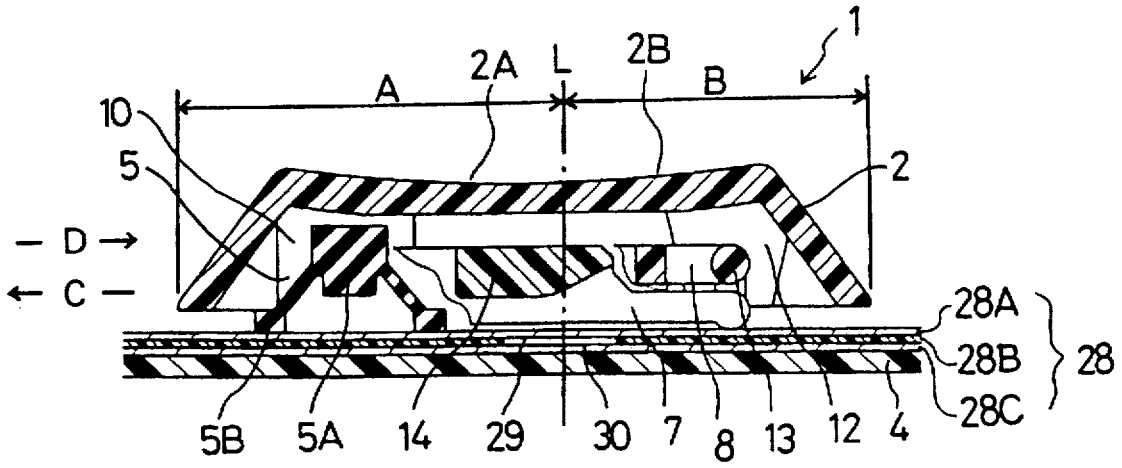
FIG. 13 is a cross-sectional view showing the non operating position of the key top according to the third embodiment.

In FIGS. 9 and 10, the slide member 28A is moved to the extremity in the D direction, so that the rubber spring 5 and the movable electrode 29 are aligned with the pair of fixed contact patterns 30. Therefore, the movable electrode 29 can be brought into contact with the pair of fixed contact patterns 30 as shown in FIG. 11 when the key top 2 is depressed. On the other hand, in FIGS. 12 and 13, the slide member 28A is moved to the extremity in the C direction, so that the rubber spring 5 and the movable electrode 29 are offset from the pair of fixed contact patterns 30, and at the same time the slide guide member 3 is disengaged from the rubber spring 5.

According to the third embodiment, similar to the foregoing embodiments, the first and second link members are directly held by the support plate, i.e., the third and forth holding portions thereof without employment of a holder member. Therefore, simple and light weight device results. Further, because the print circuit portion 28C and the printed spacer 28B are provided by printing on the support plate 4, numbers of the components can be reduced, to lower production cost and to facilitate assembling work.

Figure 15:
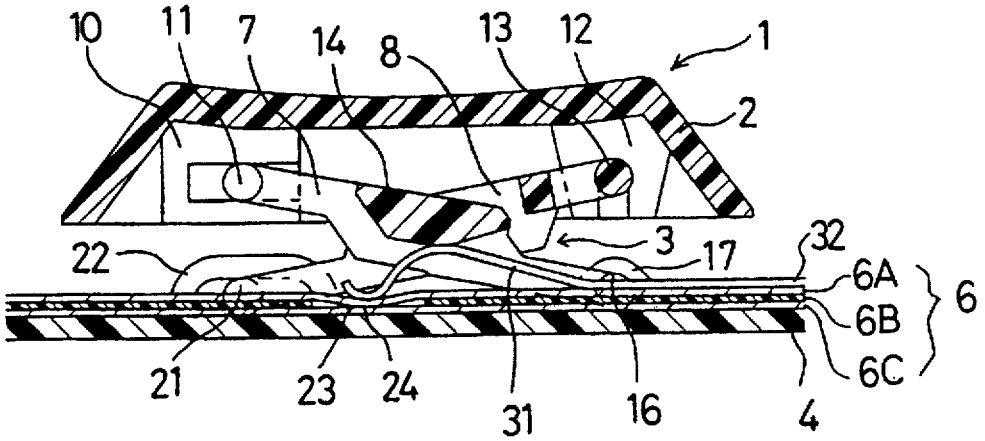
FIG. 15 is a cross-sectional view showing the depressed position of the keyswitch device according to the fourth embodiment.
Figure 16:
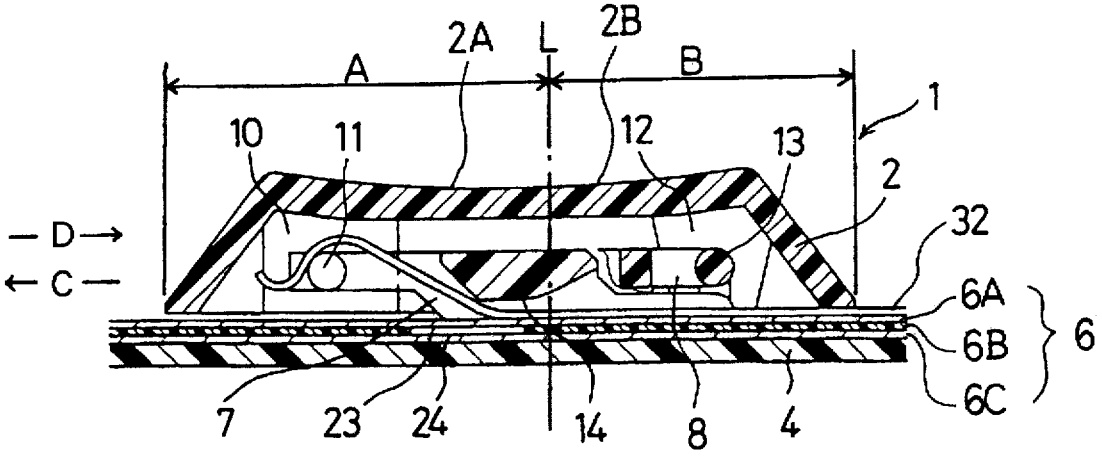
FIG. 16 is a cross-sectional view showing the non operating position of the key top according to the fourth embodiment.

A keyswitch device 1 according to a fourth embodiment of the present invention will be described with reference to FIGS. 14 through 16. In the fourth embodiment, the circuit board 6 is the same as that of the first embodiment. However, the circuit board 6 is not movable but is stationary. Further, in the fourth embodiment, the rubber spring 5 in the foregoing embodiments is not provided. Instead, a leaf spring 31 is provided. The leaf spring 31 has a base end integrally provided with a slide plate 32 disposed slidably on the circuit board 6. The leaf spring 31 has a free end seatable on and pressable against the circuit board 6 at a position in alignment with the first and second switching electrodes 23 and 24 as shown in FIG. 15. The leaf spring 31 has an intermediate portion in contact with the base portion 14 of the first link member 7 so as to urge the key top 2 upwardly.

The slide plate 32 with the integral leaf springs 31 can be manufactured simply by press working, and therefore, total production cost for the keyswitch device can be reduced. In contrast, according to the first and third embodiments, attachment work is required for attaching each rubber spring 5 onto the first flexible circuit board 6A or the slide member 28A.

Figure 14:
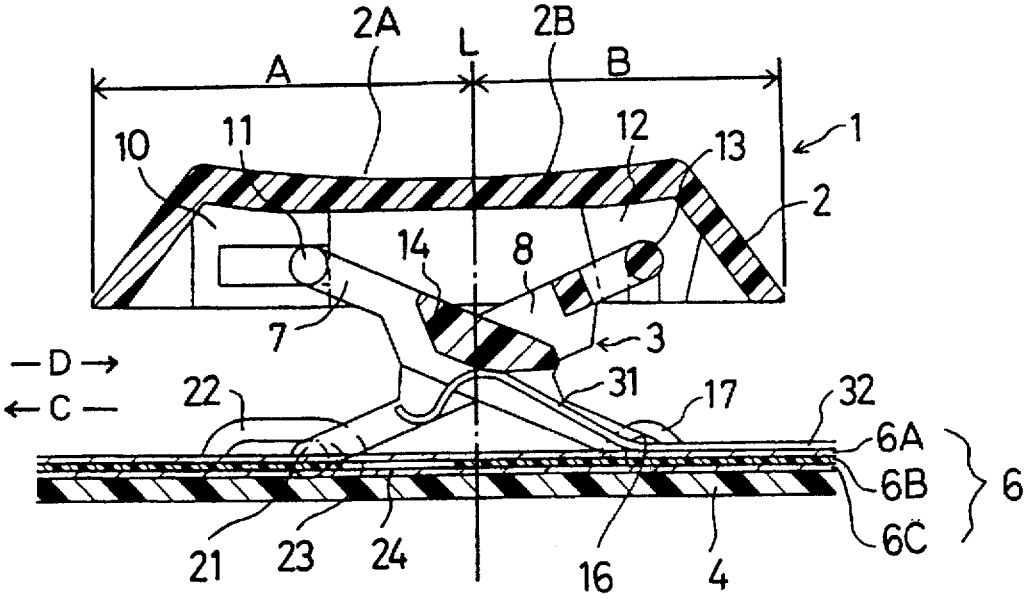
FIG. 14 is a cross-sectional view showing a keyswitch device according to a fourth embodiment when a key top is located at an operation position.

FIG. 14 shows a operation position of the key top 2. In the operation position, the slide plate 32 is positioned at the extremity of the D direction, so that the intermediate portion of the leaf spring 31 biasingly supports the guide support member 3. Thus, the key top 2 is positioned at its uppermost position. FIG. 15 shows a depressed position of the key top 2. In this state, the free end of the leaf spring 31 presses the first flexible circuit board 6A, so that the first switching electrode 23 is brought into contact with the second switching electrode 24.

For reducing the height of the key top 2 for the purpose of transport, the slide plate 32 is slidingly moved to the extremity of the C direction, so that the intermediate portion of the leaf spring 31 which is integral with the slide plate 32 is gradually disengaged from the base portion 14 of the first link member 7. Therefore, the first and second link members 7 and 8 are gradually slanted down by their pivotal movement about the pivot shaft 9 and the pivot hole 19. In accordance with the pivotal motion, the key top 2 is gradually lowered. When the base portion 14 is completely disengaged from the leaf spring 31, the first and second link members 7 and 8 are lain on the first flexible circuit board 6A as shown in FIG. 16, and at the same time, no resilient force is transmitted to the key top 2 from the leaf spring 31. Thus, the key top 2 has the lowermost position.

If the key operation is needed, the slide plate 32 is moved to its extremity position in the D direction. As a result, the leaf spring 31 which is integral with the slide plate 32 is moved underneath the base portion 14, and finally, the intermediate portion of the leaf spring 31 urges the base portion 14 upwardly to obtain uppermost position of the key top 2.

Figure 17:
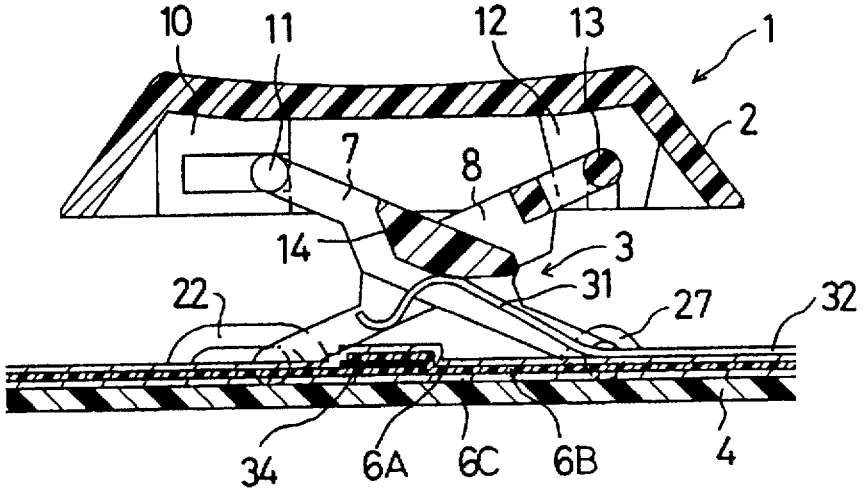
FIG. 17 is a cross-sectional view showing a keyswitch device according to a modification to the fourth embodiment.

FIG. 17 shows a modification to the fourth embodiment. In the modified embodiment, a piezoelectric element 34 is provided by printing at a position corresponding to the position of the first and second switching electrodes 23 and 24. Each piezoelectric element 34 is provided at a spliced portion of the spacers 6B.

As described above, in the keyswitch assembly of the fourth embodiments, in addition to the advantages attendant to the first through third embodiments, attachment work for attaching the rubber springs onto the circuit board 6 or the slide member 28A can be omitted.

A keyswitch device according to a fifth embodiment of the invention will next be described with reference to FIGS. 18 through 26. In the fifth embodiment, a holder member which is eliminated in the first through fourth embodiments is provided. However, the fifth embodiment provides advantage in that key top(s) belonging to a selected group of key tops can be made inoperative while operating other key tops.

Figure 18:
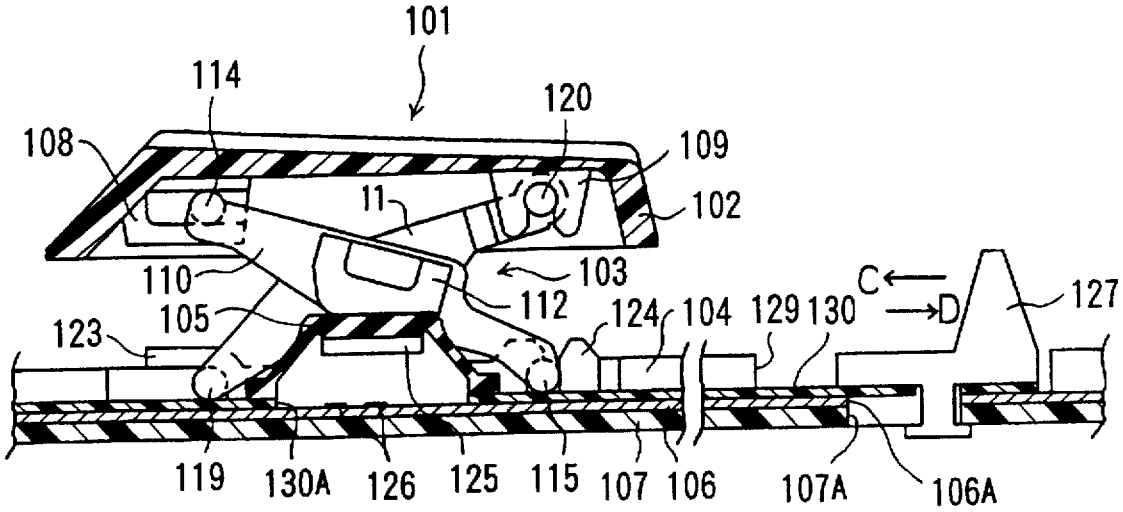
FIG. 18 is a cross-sectional view showing a keyswitch device according to a fifth embodiment when a key top is located at an operation position.

As shown in FIG. 18, the keyswitch device 101 includes a key top 102, a guide support member 103 having a first link member 110 and a second link member 111, a rubber spring 105, a circuit board 106 and a support plate 107, which are similar to those of the foregoing embodiments. The fifth embodiment further includes a holder member 104 for holding the slide guide member 103, and a slide base 130 disposed immediately below the holder member 104. The rubber spring 105 is disposable below the slide guide member 103 and is fixed to the slide base 130. The circuit board 106 is disposed below the slide base 130, and the support plate 107 is disposed below the circuit board 106.

Similar to the first through fourth embodiments, the key top 102 is formed of ABS resin or the like, and characters, symbols etc. are printed on the upper surface of the key top 102. Further, similar to the foregoing embodiments, a pair of first holding portion 108 each formed with an elongated horizontal groove are formed on the back surface of a slide-connection portion (left-hand portion in FIG. 18) of the key top 102. Also, a pair of second holding portion 109 each formed with a circular hole are formed on the back surface of a pivot-connection portion (right-hand portion in FIG. 18) of the key top 102.

Figure 19:
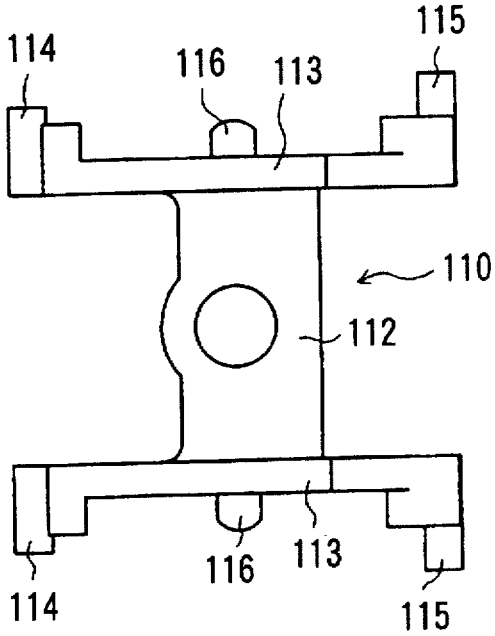
FIG. 19 is a plan view showing one link member according to the fifth embodiment.

The first and second link members 110 and 111 are pivotally connected to each other at a pivot shaft 116. The first link member 110 is best shown in FIG. 19. Similar to the foregoing embodiments, the first link member 110 is formed of polyacetal resin or the like and has a substantially H-shape in plan view. The first link member 110 includes a base portion 112 and a pair of plate portions 113 formed at both sides of the base portion 112. The base portion 112 is adapted to be mounted on a top of the rubber spring 5. A first slide pin 114 is provided at one end of each plate portion 113 so as to extend outwardly. Each first slide pin 114 is slidingly engageable with the elongated groove of the first holding portion 108.

A first holding pin 115 is provided at the other end of each plate portion 113 so as to extend outwardly. Each first holding pin 115 is rotatably held by a fourth holding portion 124 formed in the holder member 104 described later. The pivot shaft 116 is provided substantially at the central position of each plate portion 113 so as to project outwardly. The pivot shaft 116 is rotatably engaged with the second link member 111.

Figure 20:
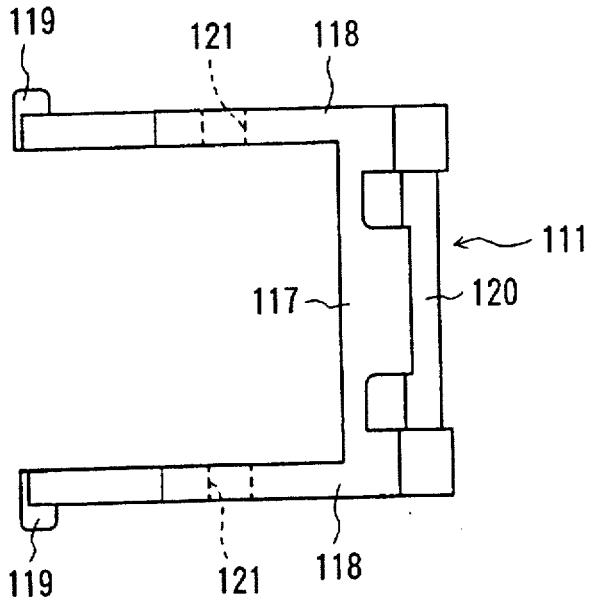
FIG. 20 is a plan view showing another link member according to the fifth embodiment.

The second link member 111 is best shown in FIG. 20. Like the first link member 110, the second link member 111 is preferably formed of polyacetal resin or the like, and it has a substantially U-shape in plan view. The second link member 111 includes a base portion 117 and a pair of plate portions 118 as shown. A second slide pin 119 is provided at one end of each plate portion 118 so as to project outwardly. Each second slide pin is slidably engaged with a third holding portion 123 of the holder member 104 described later. A single second holding pin 120 is provided at the base portion 117. The second holding pin 120 is rotatably held by each second holding portion 109 of the key top 102. Each plate portion 118 has an intermediate portion formed with a pivot hole 121. Each pivot shaft 116 of the first link member 110 is rotatably supported in the pivot hole 121. Similar to the foregoing embodiments, the first and second link members 110 and 111 provide a scissors-type linkage. Further, equi-distant relationship is provided from a central axis of the pivot shaft 116 to each central axis of the pins 114,115, 119,120 similar to the foregoing embodiments.

Next, the holder member 104 will be described with reference to FIGS. 18, 21 and 22. Like the key top 102, the holder member 104 is formed of ABS resin or the like and is provided for each keyswitch device 101. Accordingly, when the keyswitch device 101 is applied to a keyboard equipped with a plurality of the keyswitches, respective holder members 104 are integrally formed in correspondence to the respective keyswitch devices 101 for holding respective slide guide members 103 on the entire keyboard.

The holder member 104 is formed with a plurality of openings 122 corresponding to respective guide support members 103. Each rubber spring 105 attached to the slide base 130 positioned immediately below the holder member 104 can project through each opening 122, and each rubber spring is movable in the opening 122 as described later. A pair of third holding portions 123 are formed at the left hand corners of the four corners of the opening 122 as shown in FIG. 21. Each third holding portion 123 is formed in an elongated shape and confronts each first holding portion 108 of the key top 102, and slidably holds the second sliding pin 119 of the second link member 111. Further, a pair of fourth holding portions 124 are formed at the right-hand corners of the opening 122 in FIG. 21. Each fourth holding portion 124 is formed in a partially circular hole shape with a slotted opening, and confronts the second holding portion 109 of the key top 102. The fourth holding portion 124 rotatably holds the first holding pin 115 of the first link member 110.

Incidentally, the opening 122 has a substantially rectangular shape. However, both the side end edges (both right and left side edges) of the opening 122 in a sliding direction of the rubber spring 105 are shaped in an arcuate fashion in conformance with an outer contour of the dome portion of the rubber spring 105, so that sliding stroke of the rubber spring 105 can be sufficient without any interference with the edge of the opening 122 when the rubber spring 105 is moved in the C-D directions.

Next, the circuit board 106 and the slide base 130 will be described with reference to FIGS. 18, 21, 22 and The circuit board 106 is provided by a flexible circuit board made of PET film to which a predetermined circuit pattern is formed. The lower surface of the circuit board 106 is stationarily supported on the support plate 107. On the upper surface of the circuit board 106, the slide base 130 formed of PET film is disposed slidably with respect to the circuit board 106. That is, a predetermined clearance is provided between the holder member 104 and the circuit board 106. The clearance is slightly greater than the thickness of the slide base 130. Further, the holder member 104 and the circuit board 106 are connected together at several portions by caulking or screw-fastening. Thus, the slide base 130 is slidably held in the clearance.

The slide base 130 is formed with oblong shaped holes at positions corresponding to the caulking or screw-fastening portions between the holder member 104 and the circuit board 106, so that the slide base 130 can be slidingly movable in the clearance in the C-D directions without interference with the caulking or screw-fastening portions.

Figure 21:
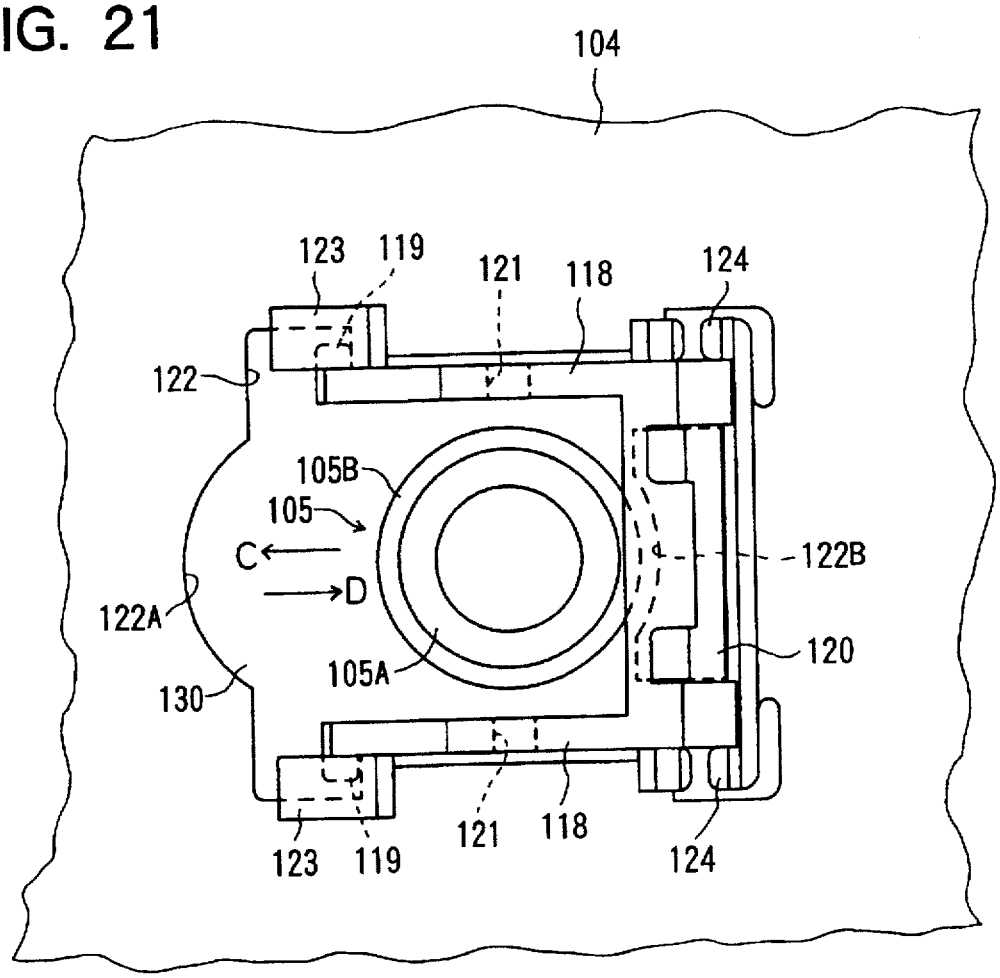
FIG. 21 is a view showing a geometrical relationship between a holder member and a rubber spring at the operation position of the key top prior to sliding movement of the rubber spring according to the fifth embodiment.

As shown in FIGS. 18 and 21, the rubber spring 105 is attached onto the slide base 130. Similar to the foregoing embodiments, the rubber spring 105 can be positioned immediately below the pivot connecting portion between the first and second link members 110 and 111. Further, the rubber spring 105 is made of elastic material such as a silicone rubber and EPDM, and has a dome portion 105A and an annular edge portion 105B provided at the circumference of the dome portion 105A.

The dome portion 105A has a top wall portion whose upper surface receives the base portion 112 or the pivot connecting portion of the guide support member 103. Because of the elastic force of the rubber spring 105, the guide support member 103 is biased to its upward position. In accordance with the sliding movement of the slide base 130, the rubber spring 105 is moved along with the slide base 130.

The top wall of the dome portion 105A has a lower surface attached with a movable electrode 125. The slide base 130 is formed with an opening 130A at a position inside the annular edge portion 105B so as to confront the movable electrode 125 with a pair of fixed electrodes 126. The fixed electrodes 126 serve as a switching electrode formed on the circuit board 106. The movable electrode 125 is brought into contact with the fixed electrodes 126 upon depression of the key top 102 for performing switching.

Incidentally, as shown in FIG. 18, the pair of fixed electrodes 126 are slightly leftwardly offset from the movable electrode 125. This is due to the fact that the first slide pin 114 of the first link member 110 and the second slide pin 119 of the second link member 111 are slidingly moved in the elongated slots of the first holding portion 108 and the third holding portion 123 when the key top 2 is depressed. This sliding connection between the pins 114, 119 and the holding portions 108, 123 will causes shifting of the movable electrode 125 leftwardly in FIG. 18. By the leftward offset of the fixed electrodes 126, the movable electrode 125 can be contacted with the fixed electrodes 126 in vertical alignment therewith.

An operation knob 127 is attached onto the slide base 130 at a position remote from the rubber spring 105 so as to manually move the slide base 130 in the C-D directions. The operation knob 127 is engagedly attached to the support plate 107. To this effect, the circuit board 106 and the support plate 107 are formed with through holes 106A and 107A in alignment therewith as shown in FIG. 18.

Figure 23:
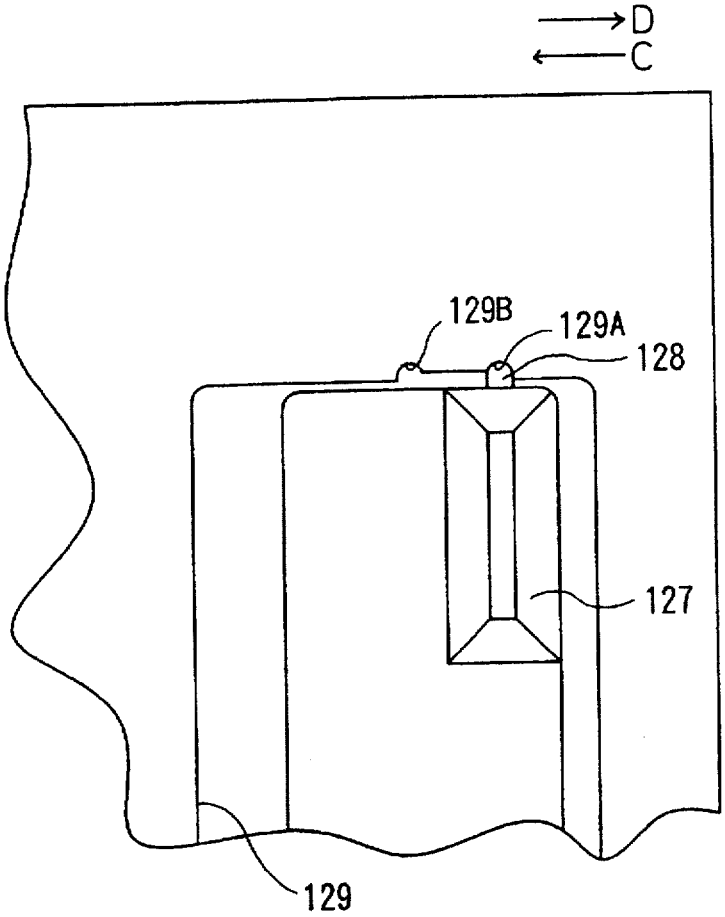
FIG. 23 is a plan view showing a locking state of an operation knob according to the fifth embodiment.
Figure 24:
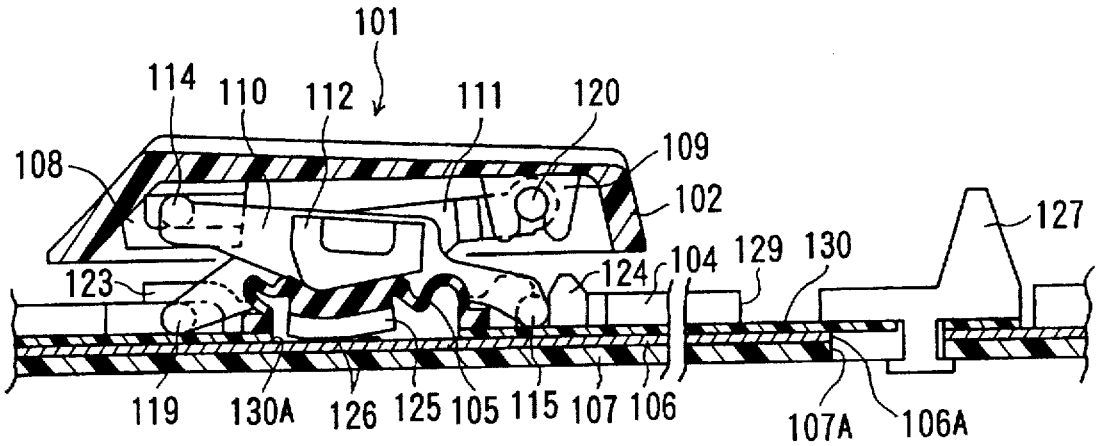
FIG. 24 is a cross-sectional view showing a depressed position of the keyswitch device according to the fifth embodiment.
Figure 25:
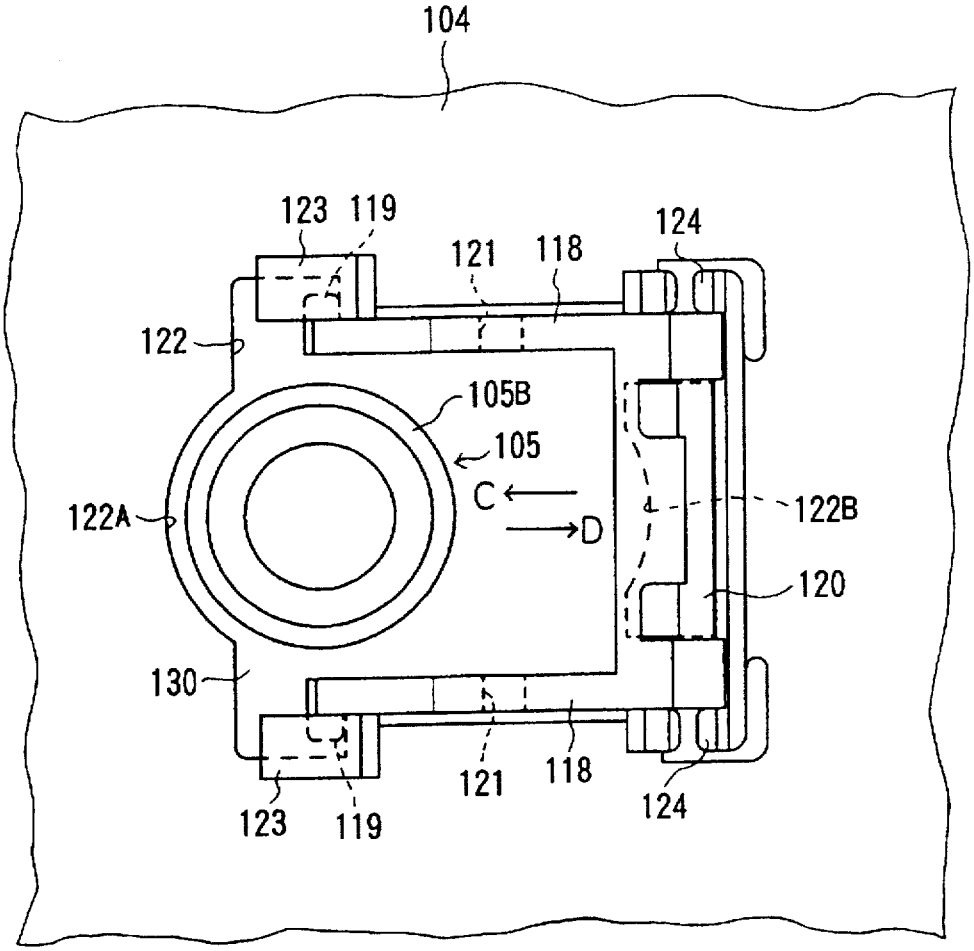
FIG. 25 a view showing a geometrical relationship between the holder member and the rubber spring at a non operation position of the key top after sliding movement of the rubber spring according to the fifth embodiment.
Figure 26:
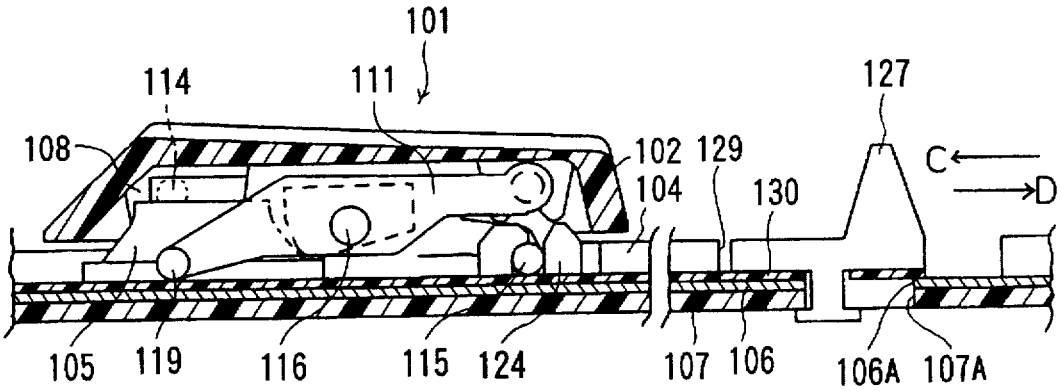
FIG. 26 is a cross-sectional view showing the non operating position of the key top according to the fifth embodiment.

Further, as shown in FIG. 23, a positioning projection 128 is provided at each end portion of the operation knob 127. In FIG. 23, only one positioning projection 128 is shown. Furthermore, the holder member 104 is formed with two positioning grooves 129A, 129B. The positioning projection 128 is selectively engageable with one of the positioning grooves 129A and 129B upon sliding movement of the slide base 130 by pushing the operation knob 127 in the direction D or C. More specifically, if the slide base 130 is moved to the extremity of the D direction, the positioning projection 128 is brought into engagement with the positioning groove 129A. Thus, operating position of the key top 102 can be maintained as shown in FIGS. 18, 21, 23 and 24. In this state, the rubber spring 105 is at its engaging position with the guide support member 103, so that the key top 2 can be maintained at its upper position. On the other hand, if the slide base 130 is moved to the extremity of the C direction, the positioning projection 128 is brought into engagement with the positioning groove 129B. Thus, non-operating position of the key top 102 can be maintained as shown in FIGS. 25 and 26. In this state, the rubber spring 105 is disengaged from the guide support member 103, so that the guide support member 103 is lain to lower the key top 102.

Figure 22:
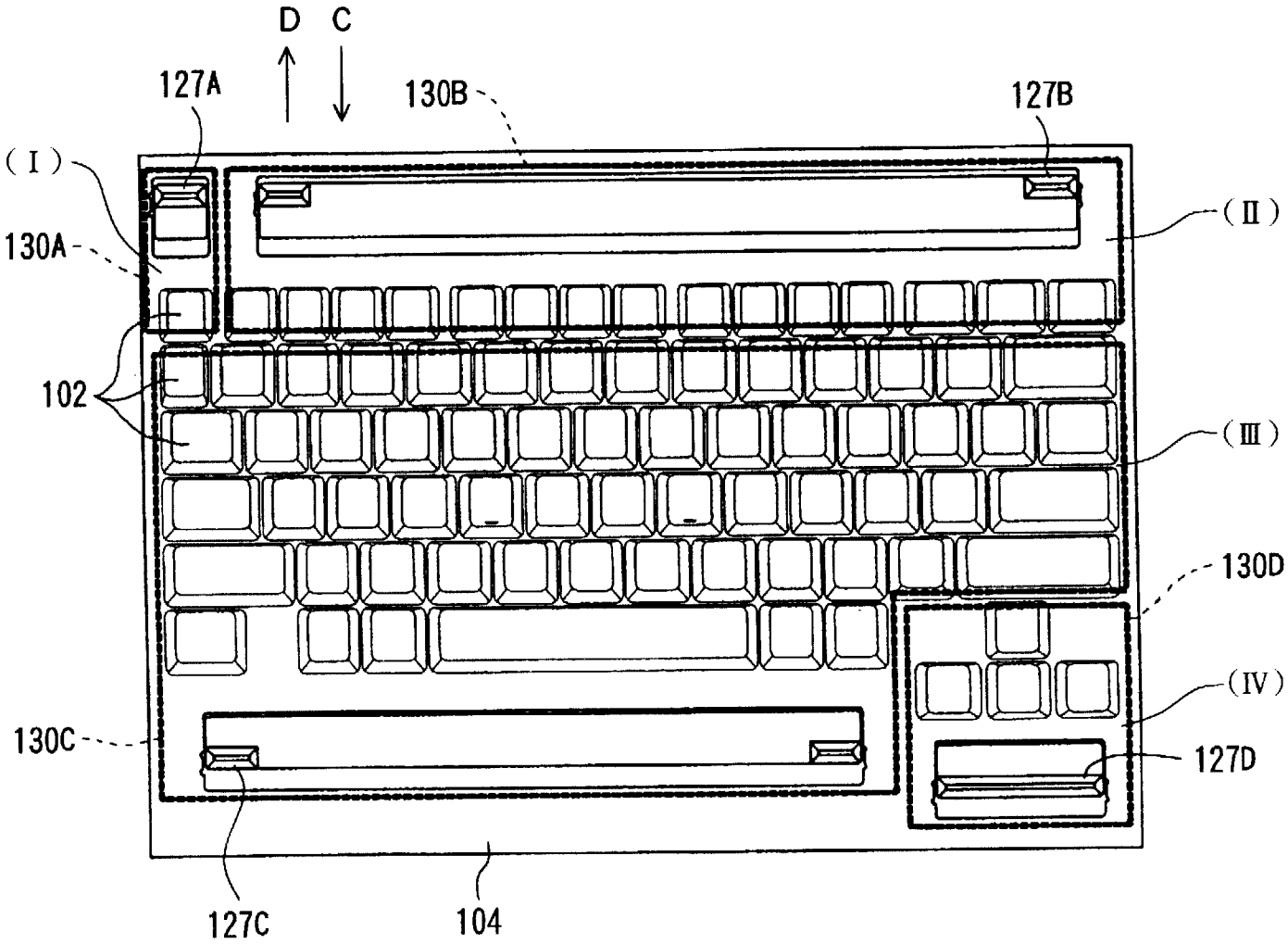
FIG. 22 is a plan view showing a keyboard device including a plurality of the keyswitch devices according to the fifth embodiment.

In the depicted embodiment, as shown in FIG. 22, the key tops 2 are divided into four groups, i.e., an escape key group (I),function key group (II), input key group (III), and cursor key group (IV), and the slide base 130 is divided into corresponding four slide bases 130A through 130D. The slide bases 130A, 130B, 130C, 130D have operation knobs 127A, 127B, 127C and 127D, respectively, those being independently manipulatable in the C-D directions. Further, the above described first and second positioning grooves 129A, 129B and a pair of positioning projections 128 are provided per each group. Therefore, height adjustment of the key top can be made independently of each group of keys by operation of a selected one of the operation knobs.

Next, a method of fabricating the keyswitch device 101 will be described. First, the holder member 104 is fixed, with a given clearance, to the support plate 107 by caulking or screw-fastening while interposing therebetween the circuit board 106 and the slide base 130 attached with the rubber spring 105. By this fixing, the slide base 130 is movable slidably at a position between the circuit board 106 and the holder member 104. Then, the pivot shaft 116 of the first link member 110 is engaged with the pivot hole 121 of the second link member 111 to fabricate the guide support member 103. Then, each second slide pin 119 of the second link member 111 is held by each third holding portion 123 of the holder member 104, and each first holding pin 115 of the first link member 110 is snappingly engaged with each fourth holding portion 124 of the holder member 104. With this state, the guide support member 103 is held on the holder member 104.

Then, the key top 102 is set above the guide support member 103, and each first slide pin 114 of the first link member 110 is held by each first holding portion 108 at the slide-connection part of the key top 102, and each second holding pin 120 of the second link member 111 is snappingly engaged with each second holding portion 109 at the pivot-connection part of the key top 102. Thus, the keyswitch device 101 can be fabricated. Upon completion of the fabrication of the keyswitch device 101, the base portion 112 of the first link member 110 is mounted on the dome portion 105A of the rubber spring 105. Therefore, the key top 102 is upwardly urged by the elastic force of the rubber spring 105 together with the guide support member 103 and held at a non-depressed position shown in FIG. 18. Incidentally, in this instance, the positioning projection 128 of the operation knob 127 is engaged with the positioning groove 129A.

Next, the switching operation of the keyswitch device 101 thus constructed is described with reference to FIGS. 18 and 24. FIGS. 18 and 24 show non-depressed and depressed position of the key top 102, respectively. In these cases, the engagement between the positioning projection 128 and the positioning groove 129A is maintained. Thus, the rubber spring 105 and the key top 102 are in their operative positions.

When the key top 102 is depressed from the state shown in FIG. 18, each first and second sliding pin 114, 119 and first and second hold pins 120 and 115 moves in the manner the same as that of the foregoing embodiments. During downward movement of the key top 102, the key top 102 maintains its horizontal posture by a cooperating action between each first and second link members 110 and 111.

Following the downward shift of the key top 102, the base portion 112 of the first link member 110 gradually presses the dome portion 105A of the rubber spring 105. When the pressing force exceeds a predetermined limit, the dome portion 105A is buckled with click touch. Through the buckling, the movable electrode 125 provided at the lower surface of the top wall of the dome portion 105A is brought into contact with the fixed electrode 126 formed on the circuit board 106. Thus, electrical short circuit occurs to provide ON state to perform ON-switching operation as shown in FIG. 24.

Upon release of the press of the key top 102, the base portion 112 of the first link member 110 is upwardly urged through the elastic restoration force of the rubber spring 105 along with the sliding movements and pivotal movements of the pins 114, 119, 120 and 115 similar to the foregoing embodiments. Following this motion, the dome portion 105A of the rubber spring 105 is gradually returned to its original state. During this restoration, the movable electrode 125 is moved away from the fixed electrode 126 to provide a OFF state, thereby performing an OFF-switching operation. The key top 102 is returned to the original non-depressed state shown in FIG. 18 through the elastic force of the rubber spring 105 while maintaining horizontal posture of the key top 102.

Next, operation for lowering the height of the key top(s) belonging to a specific group by operation of a specific operation knob 127 will be described with reference to FIGS. 18, 21, 23, 25 and 26. Incidentally, the holder member 104 and the rubber spring 105 are positioned as shown in FIGS. 18 and 21 prior to the sliding movement of the slide base 130.

First, the operation knob 127 is operated, so as to slidingly move the slide base 130 in the C direction in FIGS. 18 and 21 in the space between the holder member 104 and the circuit board 106 until the positioning projection 128 is engaged with the positioning groove 129B. During the sliding movement of the slide base 130, the dome portion 105A of the rubber spring 105 is gradually disengaged from the base portion 112 of the first link member 110. When the base portion112 is brought into abutment with the frusto-conical wall of the dome 105A, the first and second link members 110 and 111 are folded and lain due to non application of the upward elastic force from the rubber spring 105. Accordingly, the height of the key top 102 is gradually lowered.

When the base portion 112 of the first link member 110 is completely separated from the dome portion 105A, the first and second link members 110, 111 are completely folded and is lain on the slide base 130. At the same time the key top 102 is at its lowermost position as shown in FIG. 26 where no elastic force from the rubber spring 105 is applied to the guide support member 103. This position of the rubber spring 105 is its disengaged position, and this position of the key top 102 is its non operating position.

When the keyswitch device 101 is used, in order to return the key top 102 to the operation position, according to the operation inverse to the above operation, the slide base 130 is shifted as much as possible to the direction indicated by the arrow D in FIGS. 18 and 21 until the positioning projection 128 is engaged with the positioning groove 129A. During the sliding movement of the slide base 130, the dome portion 105A is gradually moved under the lower side of the base portion 112 of the first link member 110, and finally is mounted at the top surface of the dome portion 105A. This position of the rubber spring 105 is its engaging position. With this operation, the folded first and second link members 110, 111 are returned to their original states, and the height of the key top 102 gradually increases, so that it is returned to the original operational position shown in FIG. 18.

In FIG. 22, if all operation knobs 127A through 127D are operated to be moved in the C direction, height of all key tops 102 are lowered which cause thinning of the entire keyboard for facilitating transport. On the other hand, if specific operation knob is operated in the C direction, the height of the specific key top(s) is lowered. This implies that the specific key top(s), i.e., unwanted key top(s) becomes inoperative while operating other key tops.

In the keyswitch device 101 according to the fifth embodiment, the holder member 104 does not have a stem portion for guiding sliding movement of the key top. Therefore, thickness of the keyswitch device can be reduced. Further, selected key top(s) can be rendered inoperative while maintaining operative state of the other key tops. Accordingly, erroneous key inputting operation with respect to the unwanted key(s) can be avoided. Furthermore, a plurality of groups of key tops can be set, and the selection of the key operative or inoperative positions can be made with respect to each group. Accordingly, desired key inputting operation can be performed depending on various demand and use of the keyboard.

While the invention has been described in detail and with reference to the specific embodiments thereof, it would be apparent to those skilled in the art that various changes and modifications may be made therein without departing from the spirit and scope of the invention.

For example, in the first through fourth embodiments, the support plate 4 is provided by press working a metal plate such as aluminum plate. However, it is possible to provide the support plate by a resin having high rigidity. Further, in the depicted embodiments, the circuit board 6 is made from polyethylene terephthalate (PET) film, or the print circuit pattern on a metal plate and the PET film. However, the circuit board can be made of a substrate formed of paper-phenol or glass-epoxy resin, and a circuit pattern is formed on the substrate to provide the fixed contact pattern. In this case, the rubber spring is attached with the movable electrode positioned above the fixed contact pattern.

Further, in the first embodiment, the circuit board 6 is constituted by three polyethylene terephthalate (PET) films, and three films are movable together. However, it is possible to render only the first flexible circuit board 6A slidable, or first flexible circuit board 6A and the spacer 6B slidable while stationarily maintaining the second flexible circuit board 6C.

Furthermore, in the first embodiment, three PET films are provided for the circuit board 6. However, all circuit patterns can be provided on a single PET film. In this case, the rubber spring provided with the movable electrode is attached on the slide member. Alternatively, the single PET film provided with all circuit patterns is fixed on the support plate 4, and a slide member formed of a PET film is provided on the single PET film. The slide member is fixed with the rubber springs and is formed with openings at positions corresponding to each pair of contact patterns on the single PET film so as to make contact of each movable electrode provided at the rubber spring with each pair of contact patterns. In this way, numbers of the PET films and arrangement of the circuit can be varied to provide a desired circuit board 6.

Furthermore, in the illustrated embodiments, the rubber spring 5 is depressed by the base portion 14 of the first link member 7. However, the rubber spring 5 can be pressed directly by the lower face of the key top.

Furthermore, in the illustrated embodiment, there are equi distant relationship from the pivot axis of the guide support member 3 to each center axis Of the holding pin 13, 16 or slide pin 11, 21 in order to provide a horizontal posture of the key top 2 irrespective of the vertical position thereof. However, if the swinging movement of the key top 2 is intended, the equi-distant relationship is not required.

Furthermore, in the illustrated embodiment, the third and fourth holding portions 22 and 17 are provided integrally with the support plate 4. However, these holding portions can be provided by separate components and can be attached to the support plate.

Furthermore, in the illustrated embodiments, all the third and fourth holding portions 22 and 17 are positioned in a linear alignment with one another. However, the linear alignment of all holding portions is not a requisite arrangement. Instead, a part of the third and/or fourth holding portions can be positioned offset from the straight line. Further, a part of the third and/or fourth holding portions can be directed to a different direction, for example, in the direction perpendicular to the linear array direction of the holding portions. In these cases, shape and size of the slide slot 25 must be modified in accordance with the orientation and arrangement of the holding portions.

Furthermore, in the third embodiment, the slide member 28A and the switching member 5 can be formed of elastomer material so as to prevent the slide member from being its elongation during sliding movement of the slide member.

Furthermore, in the fourth embodiment, instead of the first and second flexible circuit boards 6A, 6B and the spacer 6C, the slide member 28A having movable electrods, print circuit protion 28C and printed spacer 28B those being used in the third embodiment can be used. In the latter case, the leaf springs 31 are integrally provided to the slide member 28A instead of the rubber springs. With this arrangement, the slide member and the switching member can be simplified to lower the production cost thereof.

Furthermore, in the fifth embodiment, the slide base 130 can be formed of a rubber sheet in which the rubber springs 105 are provided integrally with the rubber sheet. With this arrangement, work for attaching each rubber spring to the ambient area of the opening 130A can be eliminated.

Furthermore, in the fifth embodiment, the key tops 102 are divided into four groups as shown in FIG. 22. However, as an alternative, a group of ten keys can be provided for a spreadsheet program. In the latter case, if a mode is executed which does not require computation, it is possible to render only the ten key group inoperative so as to avoid erroneous key inputting operation. Furthermore, if ten keys and cursor keys are required in case of the key inputting operation for executing spreadsheet program, only these keys can belong to a single group.

Furthermore, in the fifth embodiment, switching operation is made by the fixed electrode 126 provided on the circuit board 106 and the movable electrode 125 provided to the top wall of the dome 105A. However, a membrane type switch can be used. In the latter case, a spacer is interposed between upper and lower switching sheets at a position below the holder member 104. At the lower face of the top wall of the dome portion, a pressing portion is provided. The pressing portion is adapted to press the upper switching sheet to provide electrical connection between the upper and lower switching sheets similar to the sheets 6A, 6B and 6C in the first embodiment.

Furthermore, in the fifth embodiment, the circuit board 106 and the slide base 130 are provided separately. However, it is possible to directly attach the rubber spring onto the circuit board, and the circuit board is slidably provided. The latter arrangement will be the integral arrangement of the circuit board with the slide base, similar to the first embodiment.

Furthermore, in the fifth embodiment, it is possible to print the circuit on the support plate 107, so that the circuit board 106 becomes integral with the support plate 107. Moreover, the holder member 104 can be made integrally with the support plate 107 printed with the circuit. This implies that the resultant arrangement would become similar to the third embodiment.

Furthermore, in the fifth embodiment, all key tops 102 are subjected to selection of the operation and non-operation. However, it is possible to provide the keyboard in which a specific key top(s) is subjected to the selection while other key tops are held in the operative position only without having the selection mechanism.

Furthermore, in the fifth embodiment, the holder member can be divided into a plurality of holder members, and a selected one of the holder member is made slidable independent of the other holder members. In the latter case, the rubber spring is made stationarily by fixing the rubber spring to the circuit board and the slide base is dispensed with. Further, the circuit board can be integral with the support plate.

According to the grouping concept of the fifth embodiment, a plurality of keyswitch device are divided into at least first and second groups, and respective first and second slide mechanism are provided, whereby the selection of the operating and non operating position of the key tops belonging to the first group is performed independently of the selection of the operating and non operating position of the key tops belonging to the second group. This grouping concept can be applied to the first through fourth embodiments in which the holder member 104 in the fifth embodiment is not provided. Therefore, in order to realize the grouping concept of the fifth embodiment in the first through fourth embodiments, for example, in the first embodiment, the circuit board 6 can be divided into several sections for independent sliding movement of each divided section, in the second embodiment, the elastomers slide member 27 can be divided into several sections, in the third embodiment the slide member 28A of the circuit pattern portion 28 can be divided into several section, and in the fourth embodiment the slide plate 32 can be divided into several sections. In each divided section, an operation knob like the knob 127 of the fifth embodiment can be fixed.

What is claimed is:

1. A keyswitch device comprising:

a key top having an upper finger touching face and a lower face to which first and second holding portions are provided;

a support plate disposed beneath the key top, the support plate having an upper portion provided with a third holding portion facing the first holding portion and a fourth holding portion facing the second holding portion;

a switching pattern provided on the support plate between the key top and the support plate;

a guide support member supporting the key top for moving the key top vertically toward and away from the switching pattern, the guide support member comprising a first link member held by the first and fourth holding portions and a second link member pivotally connected to the first link member and held by the second and third holding portions; and a switching member performing a switching operation in accordance with the movement of the key top, the switching member being movable to an operating position beneath the key top via the guide support member to make an electrical connection with the switching pattern and to a non-operating position removed from beneath the key top and disengaged from the guide support member.

2. The keyswitch device as claimed in claim 1, further comprising a circuit board disposed slidably on the support plate, the switching pattern being formed in the circuit board.

3. The keyswitch device as claimed in claim 2, wherein the switching member is attached to the circuit board.

4. The keyswitch device as claimed in claim 3, wherein the third and fourth holding portions of the support plate are arrayed side by side in a linear direction, the circuit board being slidably movable in the linear direction.

5. The keyswitch device as claimed in claim 4, wherein the circuit board has a slot extending in the linear direction for allowing the third and fourth holding portions to pass therethrough, at least one of the third and fourth holding portions being in sliding contact with the slot for guiding sliding movement of the circuit board.

6. The keyswitch device as claimed in claim 5, wherein the first link member has a lower end portion provided with a pin engageable with the fourth holding portion and the second link member has a lower end portion provided with a pin member engageable with the third holding portion, the circuit board being sandwiched between the support plate and the pin and the pin member.

7. The keyswitch device as claimed in claim 5, wherein the circuit board comprises:

a first flexible circuit board provided with a first circuit pattern;

a second flexible circuit board provided with a second circuit pattern and positioned below the first circuit pattern and above the support plate;

a spacer provided between the first and second flexible circuit pattern and formed with a hole at a position corresponding to the first and second circuit patterns for allowing the first circuit pattern to bring into contact with the second circuit pattern, the first and second circuit patterns constituting the switching pattern.

8. The keyswitch device as claimed in claim 7, wherein the first and second link members provide a scissors-type linkage having a pivot portion, the pivot portion being seated on the switching member at the operating position of the switching member.

9. The keyswitch device as claimed in claim 1, further comprising a circuit board disposed stationarily on the support plate, the switching pattern being formed in the circuit board as a fixed contact pattern.

10. The keyswitch device as claimed in claim 9, further comprising a slide member disposed slidably on the circuit board, the switching member being attached to the slide member and having a movable electrode contactable with the fixed contact pattern.

11. The keyswitch device as claimed in claim 10, wherein the slide member is formed of an elastomers material, and wherein the third and fourth holding portions of the support plate are arrayed side by side in a linear direction, the slide member being slidably movable in the linear direction.

12. The keyswitch device as claimed in claim 11, wherein the slide member has a slot extending in the linear direction for allowing the third and fourth holding portions to pass therethrough, at least one of the third and fourth holding portions being in sliding contact with the slot for guiding sliding movement of the slide member.

13. The keyswitch device as claimed in claim 12, wherein the first and second link members provide a scissors-type linkage having a pivot portion, the pivot portion being seated on the switching member at the operating position of the switching member.

14. The keyswitch device as claimed in claim 1, wherein the switching pattern is formed directly on the support plate by printing as a fixed contact pattern.

15. The keyswitch device as claimed in claim 14, further comprising a spacer formed on the printing but at a position other than the fixed contact pattern.

16. The keyswitch device as claimed in claim 15, further comprising a slide member disposed slidably on the spacer layer and provided with a movable electrode contactable with the fixed contact pattern, the switching member being attached to the slide member.

17. The keyswitch device as claimed in claim 16, wherein the third and fourth holding portions of the support plate are arrayed side by side in a linear direction, the slide member being slidably movable in the linear direction.

18. The keyswitch device as claimed in claim 17, wherein the slide member has a slot extending in the linear direction for allowing the third and fourth holding portions to pass therethrough, at least one of the third and fourth holding portions being in sliding contact with the slot for guiding sliding movement of the slide member.

19. The keyswitch device as claimed in claim 18, wherein the first and second link members provide a scissors-type linkage having a pivot portion, the pivot portion being seated on the switching member at the operating position of the switching member.

20. The keyswitch device as claimed in claim 1, further comprising a circuit board disposed stationarily on the support plate, the switching pattern being formed in the circuit board.

21. The keyswitch device as claimed in claim 20, further comprising a slide member disposed slidably on the circuit board, the slide member supporting the switching member.

22. The keyswitch device as claimed in claim 21, wherein the slide member comprises a plate member and wherein the switch member is provided integrally with the plate member.

23. The keyswitch device as claimed in claim 22, wherein the slide member is formed of a metal, and wherein the switch member comprises a leaf spring provided integrally with the metallic slide member.

24. The keyswitch device as claimed in claim 23, wherein the third and fourth holding portions of the support plate are arrayed side by side in a linear direction, the slide member being slidably movable in the linear direction.

25. The keyswitch device as claimed in claim 24, wherein the circuit board has a slot extending in the linear direction for allowing the third and fourth holding portions to pass therethrough, at least one of the third and fourth holding portions being in sliding contact with the slot for guiding sliding movement of the circuit board.

26. The keyswitch device as claimed in claim 25, wherein the circuit board comprises:

a first flexible circuit board provided with a first circuit pattern;

a second flexible circuit board provided with the second circuit pattern and positioned below the first circuit pattern and above the support plate;

a spacer provided between the first and second flexible circuit pattern and formed with a hole at a position corresponding to the first and second circuit patterns for allowing the first circuit pattern to bring into contact with the second circuit pattern.

27. The keyswitch device as claimed in claim 26, wherein the first and second link members provide a scissors-type linkage having a pivot portion, the pivot portion being seated on the leaf spring at the operating position of the leaf spring.

28. The keyswitch device as claimed in claim 1, further comprising a circuit board disposed stationarily on the support plate, the switching pattern being formed in the circuit board in a form of piezoelectric element.

29. A key board comprising:

a plurality of keyswitch devices, each comprising:

a key top;

a support plate disposed beneath the key top;

a switching pattern provided on the support plate;

a guide support member supporting the key top for moving the key top vertically toward and away from the switching pattern, the guide support member comprising a first link member and a second link member pivotally connected to the first link member, the first and second link members having one end connected to the key top; and a switching member performing a switching operation in accordance with the movement of the key top to make an electrical connection with the switching pattern; and at least one slide mechanism for selectively moving the switching member to an operating position where the guide support member is mounted on the switching member and to a non-operating position where the guide support member is disengaged from the switching member, the slide mechanism being selectively provided with respect to a keyswitch device independent from another keyswitch device on the key board.

30. The key board as claimed in claim 29, wherein the plurality of keyswitch devices are divided into at least first and second groups, and respective first and second slide mechanisms are provided, whereby the selection of the operating and non operating positions of the key tops belonging to the first group is performed independently of the selection of the operating and non operating position of the key tops belonging to the second group.

31. The key board as claimed in claim 30, wherein the keyswitch device further comprises a circuit board having the switching pattern and provided on the support plate;

and wherein each slide mechanism comprises a slide base disposed slidably on the circuit board and positioned below the guide support member, the switching member being provided to the slide base so as to be movable along with the slide base.

32. The key board as claimed in claim 31, wherein each slide mechanism further comprises a holder member positioned above the slide base and holding each another end of the first and second link members, the holder member being fixed to the circuit board with a space therefrom, the slide base being disposed in the space.

33. The key board as claimed in claim 30, wherein each key top has an upper finger touching face and a lower face to which first and second holding portions are provided, and wherein the support plate has an upper portion provided with a third holding portion in confrontation with the first holding portion and a fourth holding portion in confrontation with the second holding portion, and wherein each guide support member comprises a first link member held by the first and fourth holding portions and a second link member pivotally connected to the first link member and held by the second and third holding portions.

34. The key board as claimed in claim 33, further comprising at least first and second circuit boards each disposed slidably on the support plate, the switching pattern being formed in the first and second circuit boards, the respective first and second slide mechanism comprising the first and second circuit boards slidable independently of each other on the support plate.

35. The key board as claimed in claim 33, further comprising a circuit board disposed stationarily on the support plate, the switching pattern being formed in the circuit board as a fixed contact pattern;

and wherein the respective first and second slide mechanism comprise first and second slide members disposed slidably on the circuit board, the switching member being attached to the first and second slide members and having movable electrodes contactable with the fixed contact pattern, the first and second slide members being slidable independent of each other on the circuit board.

36. The key board as claimed in claim 33 wherein the switching pattern is formed directly on the support plate by printing as a fixed contact pattern;

and further comprising a spacer formed on the printing but at a position other than the fixed contact pattern;

and wherein the respective first and second slide mechanisms comprise first and second slide members disposed slidably on the spacer and provided with a movable electrode contactable with the fixed contact pattern, the first and second slide members being slidable independently of each other on the spacer, and switching members being attached to the first and second slide members.

37. The key board as claimed in claim 33 further comprising a circuit board disposed stationarily on the support plate, the switching pattern being formed in the circuit board;

and wherein the respective first and second slide mechanism comprise first and second slide members disposed slidably on the circuit board, the first and second slide members providing respective switching members and being slidable independent of each other on the circuit board.

* * * * *